US012339094B2

(12) United States Patent
Underwood et al.

(10) Patent No.: US 12,339,094 B2
(45) Date of Patent: Jun. 24, 2025

(54) ATTACHING A GRIP ATTACHMENT OR OTHER ATTACHMENT IN A RECOIL ENVIRONMENT AT THREADLESS REGION(S)

(71) Applicant: AXTS INC, Redmond, OR (US)

(72) Inventors: Joshua A. Underwood, Redmond, OR (US); Anibal Salinas, Redmond, OR (US)

(73) Assignee: AXTS INC., Redmond, OR (US)

( * ) Notice: Subject to any disclaimer, the term of this patent is extended or adjusted under 35 U.S.C. 154(b) by 0 days.

(21) Appl. No.: 18/889,282

(22) Filed: Sep. 18, 2024

(65) Prior Publication Data

US 2025/0130011 A1 Apr. 24, 2025

Related U.S. Application Data

(60) Provisional application No. 63/670,690, filed on Jul. 12, 2024, provisional application No. 63/592,519, filed on Oct. 23, 2023.

(51) Int. Cl.
*F41C 23/10* (2006.01)
*F41C 23/16* (2006.01)

(52) U.S. Cl.
CPC ..... *F41C 23/10* (2013.01); *F41C 23/16* (2013.01)

(58) Field of Classification Search
CPC ..... F41C 23/10; F41C 23/16
See application file for complete search history.

(56) References Cited

U.S. PATENT DOCUMENTS 517,555 A * 4/1894 Reed ..... F41C 23/12 42/71.01
1,015,490 A * 1/1912 Harrington ..... F41A 17/38 42/72
2,043,430 A 6/1936 Doe
(Continued)

FOREIGN PATENT DOCUMENTS

AT 15586 U1 2/2018
AU 676981 3/1997
WO 2023/249525 12/2023

OTHER PUBLICATIONS

Nomad Defense Co., Nomad 9F Magwell Extension and Backstrap Combo-Compact/Standard; https://www.nomaddefenseco.com/nomad-9f-magwell-extension-and-backstrap-combo-compact-standard/ ; at least as early as Oct. 26, 2022; pp. 1-5.
(Continued)

*Primary Examiner* — Michelle Clement
(74) *Attorney, Agent, or Firm* — Schwabe Williamson & Wyatt

(57) ABSTRACT

In various embodiments, an apparatus to operate in a recoil environment includes an attachment configured to slidable couple to a firearm, the attachment including a threadless region to couple to one or more corresponding threadless regions of at least one part: wherein the attachment includes: a slidable attachment interface to restrict a coupling movement of the attachment relative to the at least one part, to a fore/aft movement; and an additional interface associated with a plunger or other retaining part, the additional interface to restrict a fore/aft position of the attachment relative to the at least one part. Other embodiments may be disclosed and/or claimed.

30 Claims, 18 Drawing Sheets

(56) References Cited

U.S. PATENT DOCUMENTS 3,683,535 A * 8/1972 Lewis ..... F41C 23/10 42/71.02
3,710,496 A * 1/1973 Packmayr ..... F41C 23/14 42/71.01
3,739,515 A * 6/1973 Koon, Jr. ..... F41C 23/00 42/71.01
4,023,914 A 5/1977 Holmes
4,076,064 A 2/1978 Holmes
4,271,623 A * 6/1981 Beretta ..... F41C 23/04 42/72
4,520,585 A * 6/1985 Barrett ..... F41C 23/10 42/7
4,570,370 A * 2/1986 Smith ..... F41C 23/10 42/71.02
4,936,036 A * 6/1990 Sniezak ..... F41C 23/10 42/74
4,959,908 A 10/1990 Weyrauch
5,231,237 A * 7/1993 Cupp ..... F41C 23/10 42/71.02
5,438,783 A * 8/1995 Sniezak ..... F41A 9/65 42/50
5,570,529 A 11/1996 Amelino
5,621,995 A * 4/1997 Smith ..... F41A 9/65 89/33.1
5,979,098 A * 11/1999 Griggs ..... F41C 23/06 42/74
6,112,446 A * 9/2000 Forster ..... F41C 23/10 42/74
6,487,807 B1 * 12/2002 Kopman ..... F41A 23/12 42/72
6,557,287 B2 * 5/2003 Wollmann ..... F41A 9/65 42/50
6,568,115 B2 * 5/2003 Beretta ..... F41A 9/65 42/50
6,874,266 B1 * 4/2005 Kong ..... F41C 23/22 89/34
7,117,622 B2 * 10/2006 Freed ..... F41A 9/65 42/71.02
7,121,034 B2 * 10/2006 Keng ..... F41A 23/10 42/72
7,191,556 B2 * 3/2007 Pikielny ..... F41C 23/10 42/72
7,467,489 B2 * 12/2008 Gussalli Beretta ..... F41C 23/16 42/72
7,490,429 B2 * 2/2009 Moody ..... F41C 23/16 42/72
7,506,469 B2 * 3/2009 Poulin ..... F41A 11/02 42/71.02
7,587,852 B1 * 9/2009 Harms ..... F41C 23/14 42/74
7,614,174 B1 * 11/2009 Beltz ..... F41A 23/10 42/72
7,743,542 B1 * 6/2010 Novak ..... F41A 9/24 42/49.02
7,748,153 B2 * 7/2010 Beretta ..... F41C 23/10 42/71.02
7,823,855 B2 * 11/2010 Faifer ..... F16M 11/26 248/188.5
7,937,874 B2 * 5/2011 Roth ..... F41C 23/10 42/72
8,156,676 B1 * 4/2012 Moody ..... F41A 23/06 42/71.01
8,365,456 B1 * 2/2013 Shepard, Jr. ..... F41C 23/10 362/110
8,448,366 B2 * 5/2013 Faifer ..... F41G 11/003 42/72
8,448,562 B2 * 5/2013 Cottle ..... F41C 23/04 89/129.02
8,561,338 B2 * 10/2013 Chvala ..... F41C 23/08 42/74
8,590,202 B2 * 11/2013 Keng ..... F41C 27/00 42/90
8,806,791 B2 * 8/2014 Cottle ..... F41C 23/14 89/129.01
8,857,093 B2 * 10/2014 Hogue ..... F41C 23/10 42/74
8,898,949 B1 * 12/2014 Greenwood ..... F41G 11/003 42/124
9,038,305 B2 * 5/2015 Volfson ..... F41G 11/003 42/90
9,546,836 B2 * 1/2017 Cottle ..... F41C 23/14
9,612,083 B2 * 4/2017 Cottle ..... F41C 23/14
9,897,402 B2 * 2/2018 Pettit ..... F41A 9/61
10,066,885 B2 * 9/2018 Chen ..... F41A 9/65
10,101,110 B2 * 10/2018 Faifer ..... F41A 23/10
10,228,213 B1 * 3/2019 Smith ..... F41C 23/18
10,415,919 B1 * 9/2019 Harrigan ..... F41C 23/10
10,684,100 B2 6/2020 Pniel
10,731,936 B1 * 8/2020 Sapio ..... F41A 11/00
10,782,099 B2 9/2020 Zimmer
10,845,138 B2 * 11/2020 Landis ..... F41A 17/38
10,859,343 B1 * 12/2020 Glen ..... F41C 23/10
10,871,350 B1 12/2020 Thomas et al.
10,921,076 B1 2/2021 Thomas et al.
10,948,262 B2 * 3/2021 Curry ..... F41C 23/10
10,948,267 B2 3/2021 Zimmer
11,022,388 B1 * 6/2021 Noonan ..... F41A 19/14
11,073,351 B2 * 7/2021 Tai ..... F41A 9/61
11,079,189 B2 * 8/2021 Hsu ..... F41A 3/66
11,306,862 B1 * 4/2022 Ye ..... F16M 11/14
11,473,862 B2 * 10/2022 Oh ..... F41C 23/16
11,480,414 B2 10/2022 Salinas et al.
11,543,194 B2 * 1/2023 Berger ..... F41C 7/11
11,644,257 B1 * 5/2023 Roe ..... F41A 9/71 42/6
11,788,818 B2 10/2023 Roth
11,852,427 B2 12/2023 Bachstein
11,959,727 B1 4/2024 Yedor
11,982,511 B2 * 5/2024 Melville ..... F41G 11/003
12,007,202 B2 * 6/2024 Stern ..... F41G 11/003
12,078,439 B2 * 9/2024 Curry ..... F41A 19/44
12,130,120 B2 10/2024 Langdon
2002/0088159 A1 * 7/2002 McMoore ..... F41A 17/20 42/70.08
2010/0071244 A1 * 3/2010 Fitzpatrick ..... F41C 23/10 42/71.01
2010/0212202 A1 * 8/2010 Roth ..... F41C 23/10 42/71.01
2012/0222342 A1 * 9/2012 Chvala ..... F41C 23/04 42/74
2013/0139426 A1 * 6/2013 Baxley ..... F41C 23/10 42/71.02
2015/0268002 A1 9/2015 Jeung
2019/0107348 A1 * 4/2019 Harrigan ..... F41A 3/66
2020/0025520 A1 1/2020 Niswander
2021/0088310 A1 3/2021 Planck
2021/0172691 A1 * 6/2021 Hsu ..... F41A 9/71
2021/0270572 A1 9/2021 Dawson, Jr.
2021/0341236 A1 * 11/2021 Hsu ..... F41A 3/66
2022/0042773 A1 * 2/2022 Kincel ..... F41C 27/00
2022/0268553 A1 8/2022 Roth
2023/0392898 A1 * 12/2023 Hughes ..... F41G 1/35
2023/0400271 A1 * 12/2023 Underwood ..... F41A 9/70
2024/0110759 A1 4/2024 Underwood
2024/0110767 A1 4/2024 Underwood
2024/0110769 A1 4/2024 Underwood et al.
2024/0118053 A1 * 4/2024 Moretti ..... F41C 23/14
2024/0200906 A1 * 6/2024 Johnson, Sr. ..... F41G 11/003
2024/0288113 A1 * 8/2024 Johnson, Sr. ..... F41G 11/003
2024/0302117 A1 * 9/2024 Strechinski ..... F41C 23/16
2024/0302137 A1 * 9/2024 Johnson, Sr. ..... F41G 11/003
2024/0410673 A1 * 12/2024 Roberson ..... F41G 11/003

OTHER PUBLICATIONS

LokGrips; Walther PDP F-Series Magwell Brass, https://lokgrips.com/walther/walther-pdp/walther-pdp-f-series-magwell-brass/ ; at least as early as Oct. 26, 2022; pp. 1-5.

Southwest Precision; Instagram; at least as early as Oct. 2, 2022.

(56) References Cited

OTHER PUBLICATIONS

Shadow Systems; Patented Multi-Footprint Optic Cut; Optic Fit; https://shadowsystemscorp.com/opticcut/; at least as early as Oct. 2, 2022.
Next Gen Tooling; Technical Support Blog, "Use Guide Pins to Assist in Loading of Fixtures to Protect Your Investment" https://www.nextgentooling.com/technical/category/tolerance/2#:~:text=Locking%20tapers%20%2D%20These%20can%20be, Dec. 14, 2016.
Fortis; "K1 System (Tapered) Castle Nut—LETM Lightweight Enhanced AR15 End Plate" https://fortismfg.com/k1systemcastlenut-lightweightenhancedar15endplate; at least as early as Oct. 2, 2022.
Emuge-Franken, SME, "Securing Fasteners in Safety Critical Aerospace and Defense Applications" https://www.sme.org/technologies/articles/2022/december/securing-fasteners-in-safety-critical-aerospace-and-defense-applications/ Dec. 6, 2022.
Walther, Walther PDP Optic Plate Mounting System (Second Generation); https://waltherarms.com/blog/walther-pdp-optic-plate-mounting-system-2; at least as early as Oct. 2, 2022.

* cited by examiner

ATTACHING A GRIP ATTACHMENT OR OTHER ATTACHMENT IN A RECOIL ENVIRONMENT AT THREADLESS REGION(S)

BACKGROUND

This application is a non-provisional of U.S. Provisional Application No. 63/592,519 filed on Oct. 23, 2023, and U.S. Provisional Application No. 63/670,690, filed on Jul. 12, 2024, each of which is incorporated by reference herein.

BACKGROUND

Some firearms have modular grip assemblies. In one example of a modular grip assembly, a backstrap attaches to the grip frame. A grip characteristic of the firearm (e.g., grip size or grip profile/shape) may be changed by using the same grip frame in combination with a different backstrap.

DETAILED DESCRIPTION

Modular Firearm Grip Assembly

In firearms with modular grip assemblies, a backstrap may attach to a back of the grip frame using a rotatably-driven fastener. However, in recoil environments, recoil forces may cause the backstrap to loosen over time, as recoil forces are transmitted into the grip frame as well as into other components of the grip assembly. While it may be possible to still use a firearm with a grip having some "play," any play in the grip is undesirable and highly noticeable (given that an operator's hand is in contact with it). To re-tighten the rotatably driven fastener, the operator of course needs to have a rotatable driving tool (e.g., a screwdriver) available.

To reduce loosening, an operator may install a threaded rotatably driven fastener with an adhesive, such as Loctite®. However, this approach may be undesirable for reasons explained in U.S. patent application Ser. No. 18/480,451, filed on Oct. 3, 2023, which is herein incorporated by reference.

Besides the possibility of loosening from recoil, each fastener or its fastener hole may create a discontinuity in a surface of the grip assembly. For example, a fastener to attach the backstrap (or its fastener opening if it is countersunk) may create a discontinuity on a grip surface of the backstrap. This discontinuity may affect grip effectiveness (which may be impactful in, say, wet conditions), grip comfort, accumulation of debris, and/or appearance (a manufacturer may be constrained in the kind of aesthetic grip designs it can develop, when there is a requirement for a discontinuity in the grip surface). The discontinuity may have the most negative impact when it is located at a mid-back position of a backstrap, which many are as this location may enable use of only one fastener for the backstrap.

Any of the problems explained above with regard to a backstrap can affect other grip parts, such as magwells. A magwell (e.g., a flared detachable magwell) may couple to a bottom of a grip frame, and may act as a guide for loading a magazine into the magazine well of the firearm. A magwell (e.g., a flared detachable magwell) may increase the entry area of the magazine well.

Figure 7:
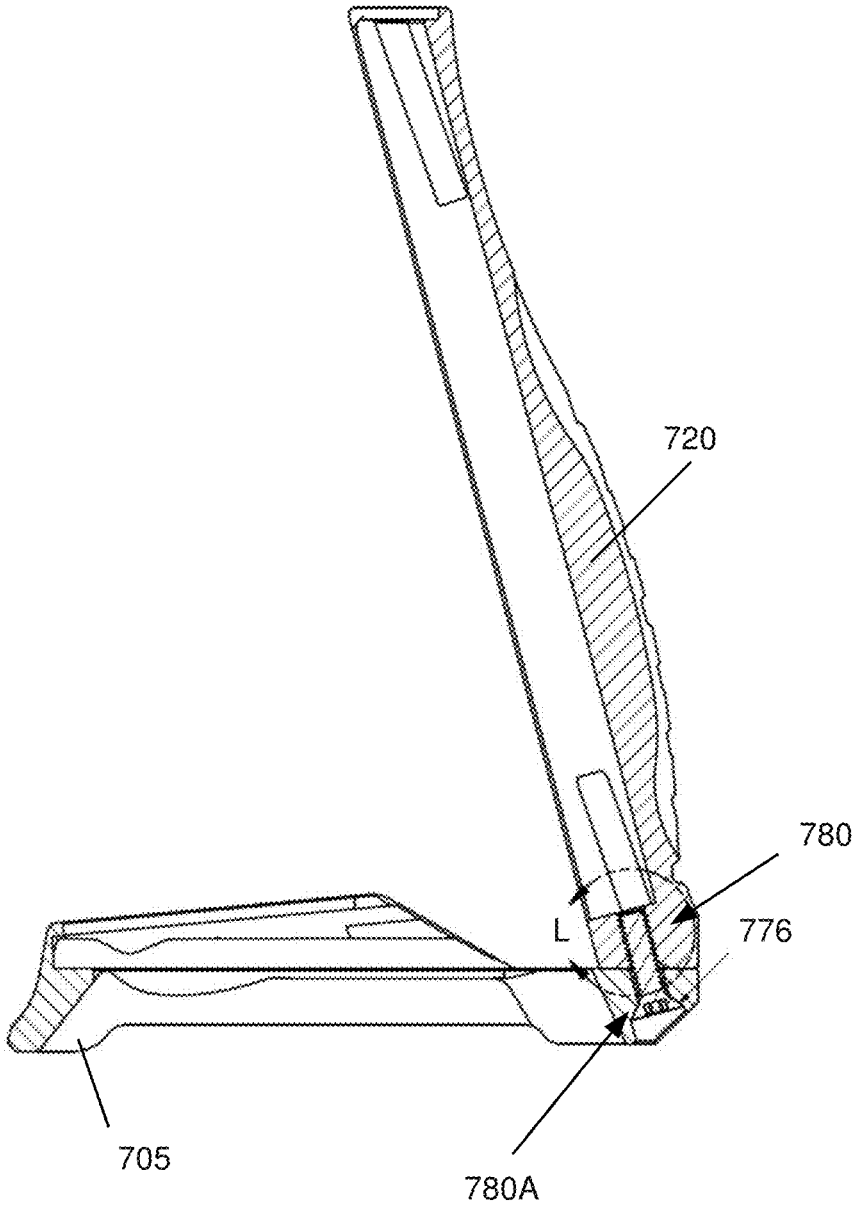
FIG. 7 illustrates a sectional view of another grip accessory assembly, according to various embodiments.

FIG. 7 illustrates a sectional view of the grip frame assembly described in more detail in U.S. patent application Ser. No. 18/480,451, filed on Oct. 3, 2023, which is herein incorporated by reference. The grip frame assembly includes a grip part 720 mountable to a modular grip assembly of a firearm (not shown), and another part 705 (e.g., a magwell in this example) coupled to different part of the grip frame. A threaded hole 780 for a rotatably-driven fastener 780A extends through magwell 705 and into backstrap 720.

The rotatably-driven fastener 780A may have features to prevent loosening due to recoil forces, e.g., self-locking threads along its length and/or a tapered head 776, as described in more detail in the '451 application. However, other advantages of this arrangement over the known arrangements that use a threaded rotatably driven fastener will be apparent to one of ordinary skill in the art (for example, the entire back surface of the separable grip may be free of discontinuities such as fastener heads or counter openings, which may provide a better grip for an operator of the firearm and allow a manufacturer to make a more unique/desirable appearance of the grip assembly).

The various advantages of the grip frame assembly described by the '451 application notwithstanding, it may still be desirable to provide some further grip assembly arrangements in which there is no requirement for a discontinuity on the part of the grip assembly to make contact with the operator's hand when operating the firearm.

Figure 1:
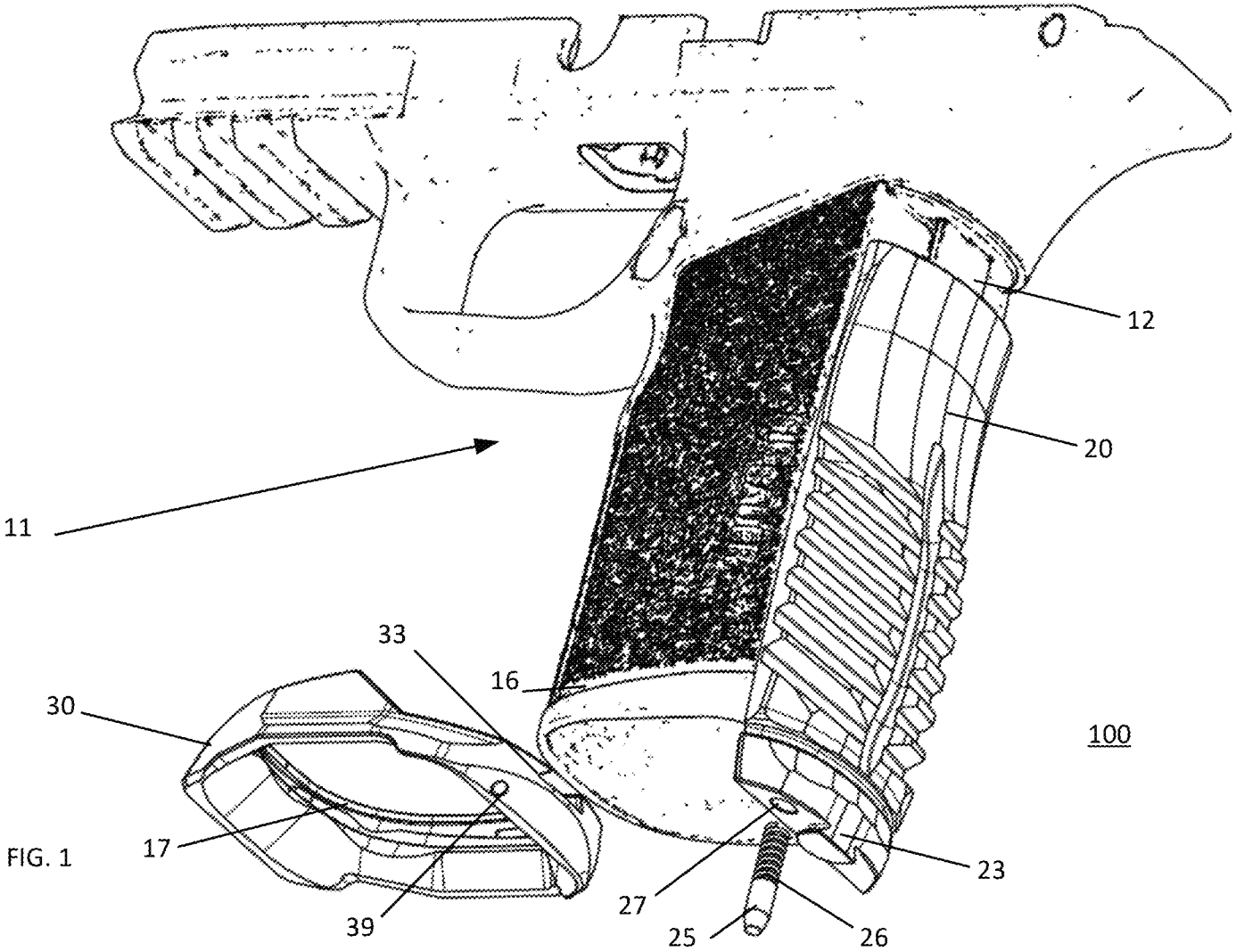
FIG. 1 illustrates an exploded isometric view of a frame assembly for a firearm, according to various embodiments.
Figure 2B:
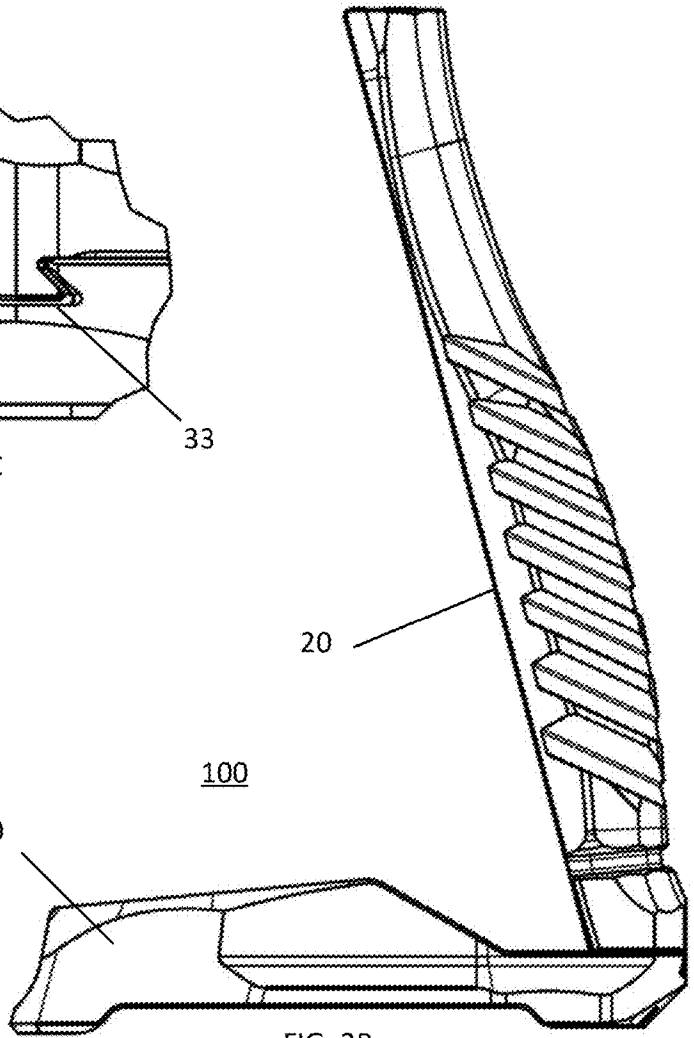
FIG. 2B illustrates a side view of the grip accessory assembly of FIG. 2A.
Figure 2C:
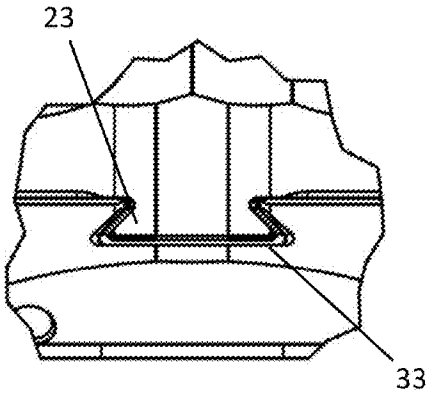
FIG. 2C illustrates a detail J of the grip accessory assembly of FIG. 2A.
Figure 2A:
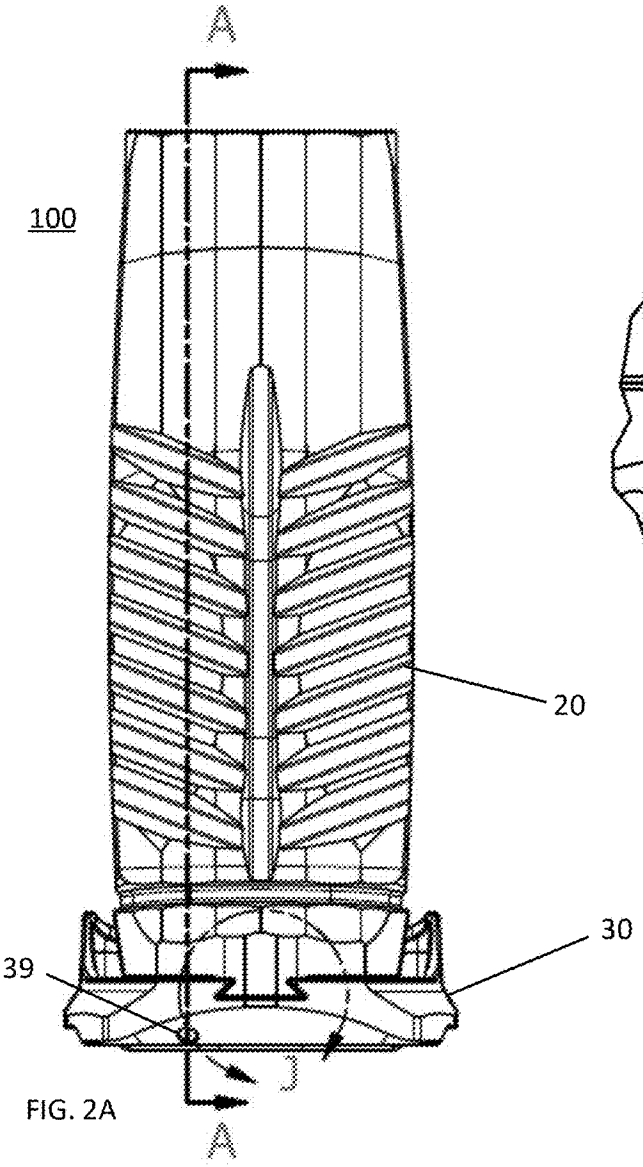
FIG. 2A illustrate a front view of a grip accessory assembly of FIG. 1, in an assembled state.

FIG. 1 illustrates an exploded isometric view of a frame assembly 100 for a firearm, according to various embodiments. The frame assembly 100 includes a grip frame 11, a first separable part 20 (e.g., a grip part, such as a backstrap), a second separable part (e.g., a grip accessory such as a magwell), and a plunger assembly (e.g., plunger 25 and spring 26).

The grip surface of the separable part 20 (e.g., the back exterior surface) does not have any fastener discontinuities for attachment features (e.g., no fastener or fastener opening on the back exterior surface). This may improve grip when operating the firearm, such as in wet conditions.

Regarding the magwell 30, instead of a fastener or fastener opening discontinuity, it has a push tool access port 39, which may have a diameter that is smaller than the head of a typical fastener used in a grip assembly 100. This push tool port 39 may receive a push tool, as opposed to a rotatable driving tool that may be required to install rotatably driven fasteners. One example of a push tool usable with the port 39 may be a paper clip or small wire.

The backstrap 20 may be backwards compatible with known grip frames, and may be mounted to the grip frame 11 in place of an original backstrap (not shown). The backstrap 20 may have an interface (e.g., one or more channels) to mate with the extrusions 12 of the grip frame 11. In various embodiments, the backstrap 20 may have other interface features to mate with known grip frames, such as a retention pin hole (not shown) to receive a retention pin (not shown) of the frame 11. In these embodiments, the backstrap 20 may define a retention pin hole (not shown) to receive a retention pin of the interface of the grip frame. The backstrap 20 may be mounted to the grip frame 11 in place of an original backstrap (not shown) using the same retention pin.

Similarly, the magwell 30 may be backwards compatible with known grip frames. For example, the backstrap 20 may have an interface 17 (e.g., a lip) to slidingly mount onto a groove 16 of the grip frame 11.

In various embodiments, the backstrap 20 may have any interface to mate with any grip frame interface now known (e.g., used on known grip frames), or later developed. The interface on the back of the grip frame may be an attachment interface (such as one or more channels) to mate with the interface of the grip frame 11 (e.g., the extrusion 12).

Figure 4A:
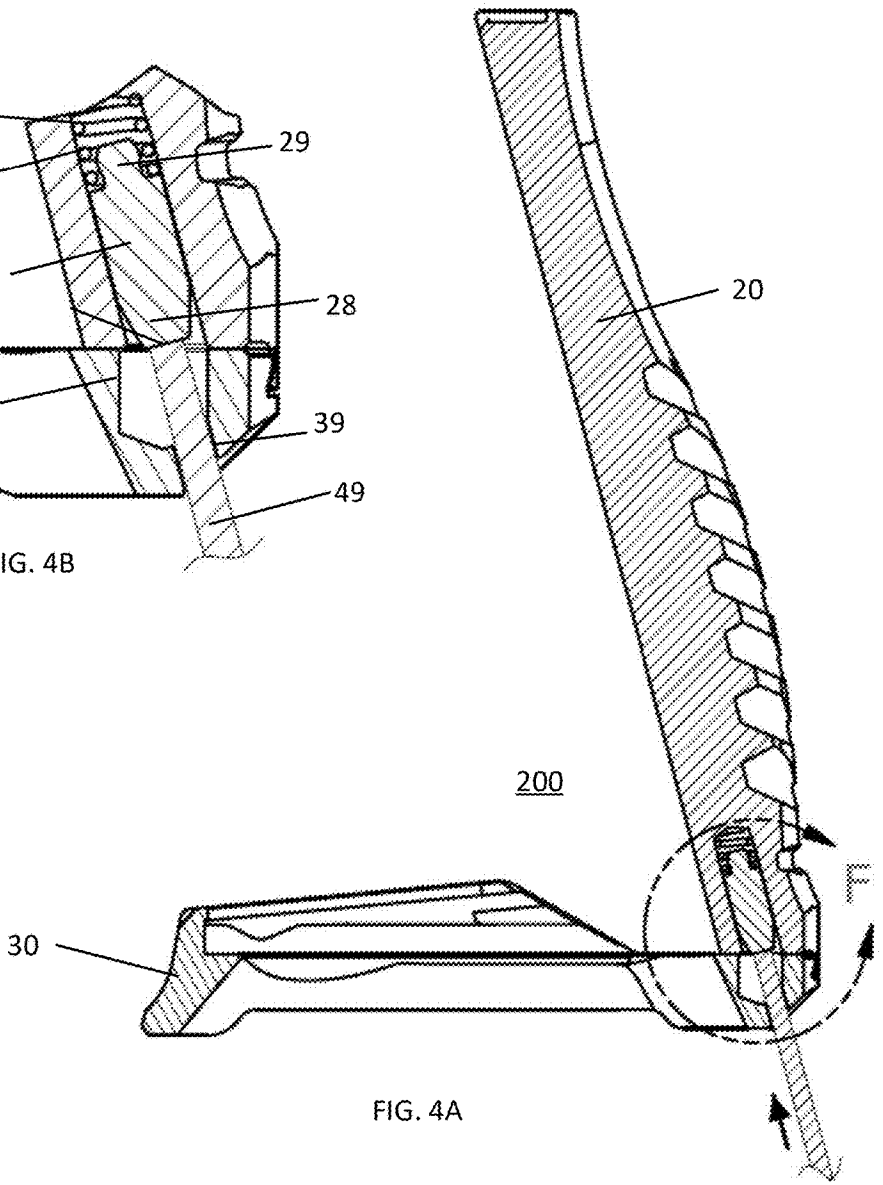
FIG. 4A illustrates a section view of the grip accessory assembly of FIG. 2A, during a first stage of disassembly, taken along section line A-A.
Figure 4B:
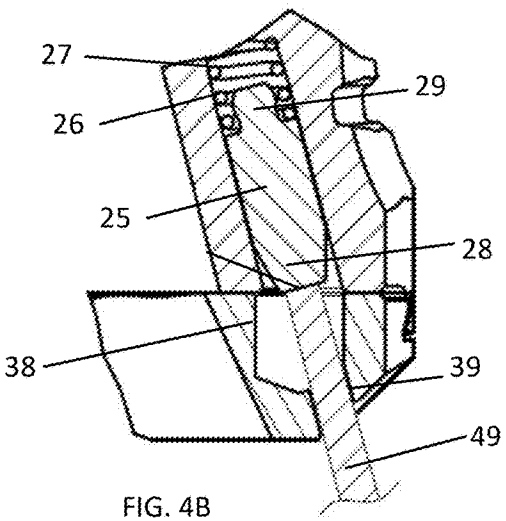
FIG. 4B illustrates a detail F of the grip accessory assembly of FIG. 4A during the first stage of disassembly.

Referring now to FIGS. 4A and 4B, a user may wish to remove the backstrap 20 for a number of reasons. For example, the grip assembly may not properly fit the hand of an intended operator. A backstrap of a different size (e.g., smaller, larger, differently shaped, etc.) may produce a better overall grip for the intended operator. Alternatively, a user may wish to replace the backstrap 20 for any other reasons such as a different material backstrap, a different atheistic design, an alternative textured pattern, or the like, or combinations thereof.

The backstrap 20 may be easily removed from the frame assembly 100 by an operator, using the plunger assembly. In a first stage of disassembly, a user may insert a push tool 49 into the port 39 to at least partially collapse the spring 26, as illustrated in FIGS. 4A and 4B. The push tool 49 may be any tool that fits into the port 39, such as an improvised tool (in some embodiments, a paper clip may be used as a tool to at least partially collapse the spring 26).

Figures 5A, 5B:
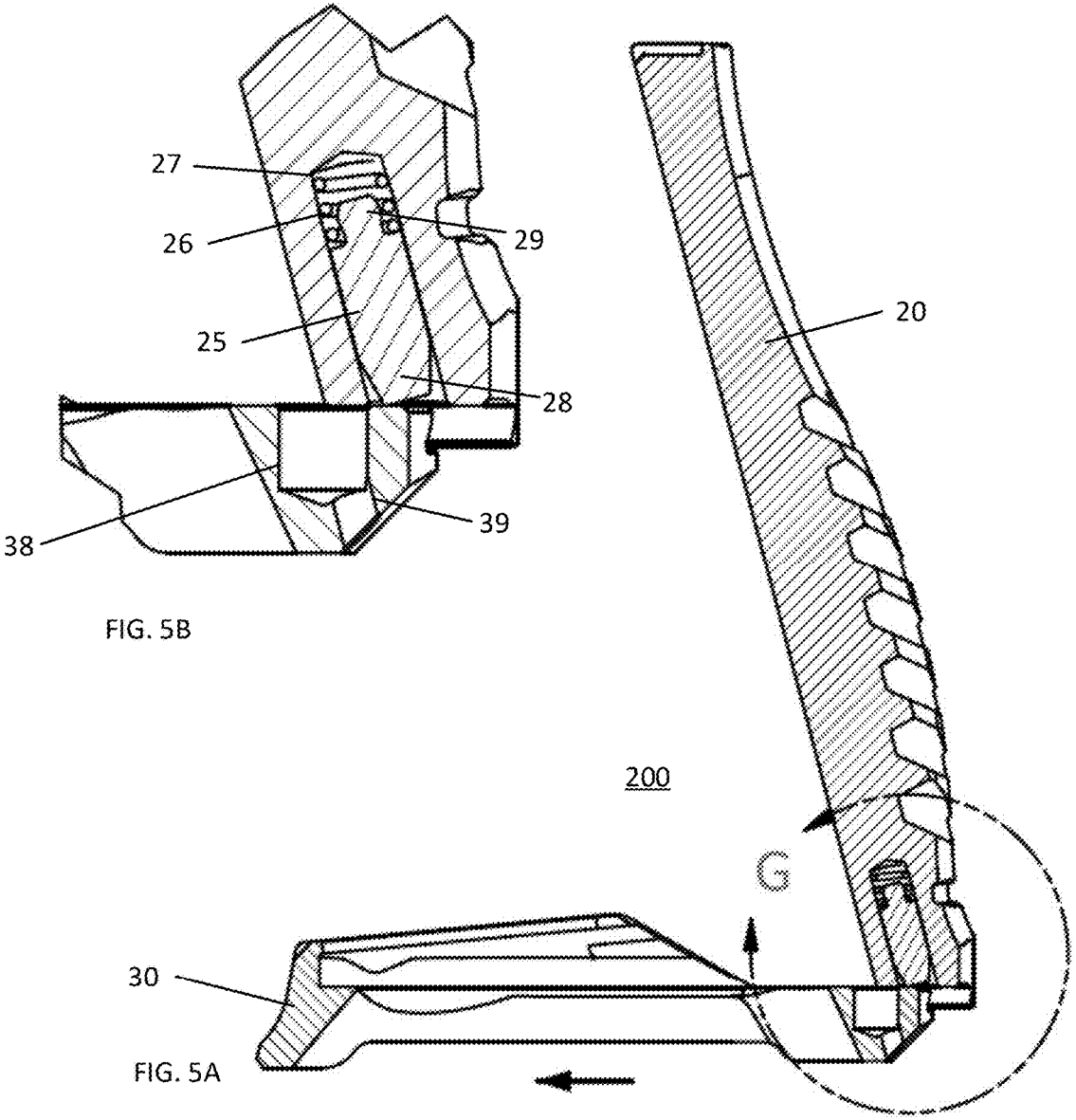
FIG. 5A illustrates a section view of the grip accessory assembly of FIG. 2A, during a second stage of disassembly, taken along section line A-A.
FIG. 5B illustrates a detail G of the grip accessory assembly of FIG. 5A, during the second stage of disassembly.

With the spring 26 partially collapsed, referring to FIGS. 5A-B the magwell 30 may be moved slidingly forward relative to the backstrap 20. This forward sliding may cause the interfaces 16 and 17 of FIG. 1 to be slidingly released from one another. The forward movement may also cause a protrusion on one or the backstrap 20 and the magwell 30 to be removed from a corresponding opening on the other of the backstrap 20 and the magwell 30. Referring to FIG. 1, in this example the opening 33 is defined by the magwell 30 and the protrusion 23 is defined by the backstrap 20. It may be possible and practical to reverse this arrangement in other embodiments (with a protrusion defined by a magwell). Also, in this embodiment the opening 33 is an undercut opening (e.g., a dovetail groove to receive a dovetail), but in other examples an opening may be some other kind of undercut opening to receive some other kind of protrusion (e.g., a T-slot).

Figures 6A, 6B:
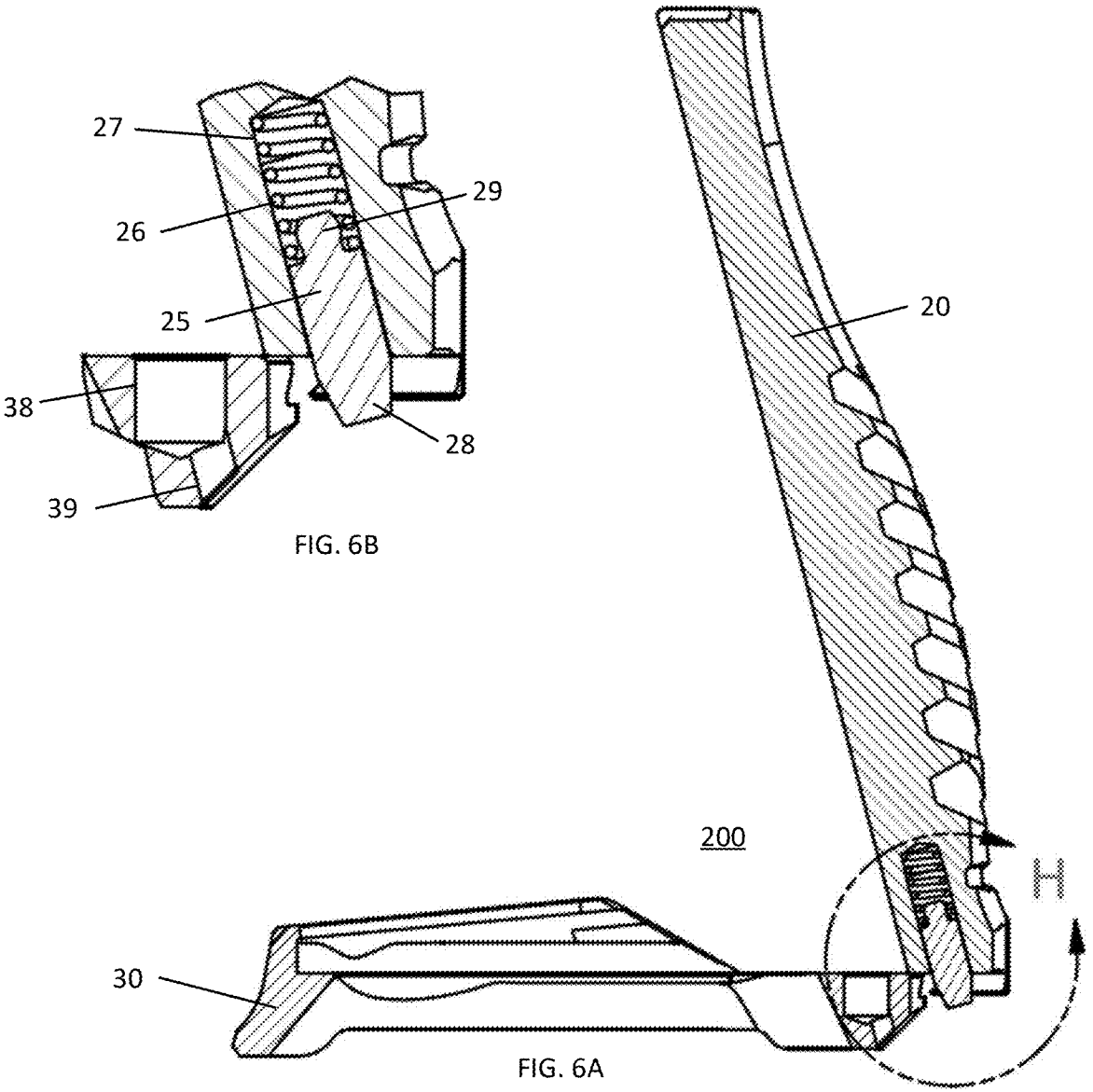
FIG. 6A illustrates a section view of the grip accessory assembly of FIG. 2A, during a third stage of disassembly, taken along section line A-A.
FIG. 6B illustrates a detail H of the grip accessory assembly of FIG. 6A, during the third stage of disassembly.

Referring to now FIGS. 6A-B, with the magwell 30 positioned from the forward movement described previously, the plunger assembly may be removed from the plunger assembly opening 27 (e.g., the plunger 25 and spring 26 may be removed). The user may then remove the backstrap 20 from the grip frame 11 (FIG. 1), such by moving the backstrap 20 downward to slidingly release it from the grip frame 11.

With the backstrap 20 removed, a user may then attach some other separable part that may have a same mounting interface as backstrap 20 to the grip frame 11 (FIG. 1). For example, the user may install a different backstrap that may be larger or smaller than the backstrap 20.

To install the different backstrap, the user may mount it on the grip frame 11 (FIG. 1) by, say a sliding upward movement. The user then may install the same plunger assembly into a plunger assembly opening on the different backstrap. The user may then slidingly move the interface 17 (FIG. 1) of the magwell 30 into the interface 16 of the grip frame 11.

While a typical reason to remove the magwell 30 and backstrap 20 may be to use a different backstrap, it should be appreciated that one may remove the magwell 30 regardless of whether the backstrap 20 is removed. It may be possible to provide another grip accessory, such as a magwell with a different well geometry or some other grip accessory having an attachment interface similar to the magwell 30. As one example, a glass breaker accessory may be provided with the same attachment interface as the magwell 30. The magwell 30 may be replaced with the glass breaker accessory, and the glass breaker accessory could retain the backstrap 20 in a similar way that the magwell 30 retains the backstrap 20. Any grip accessory or other grip part, now known or later developed, may include an attachment interface similar in various respects as the described attachment interface of the magwell 30.

Figure 3A:
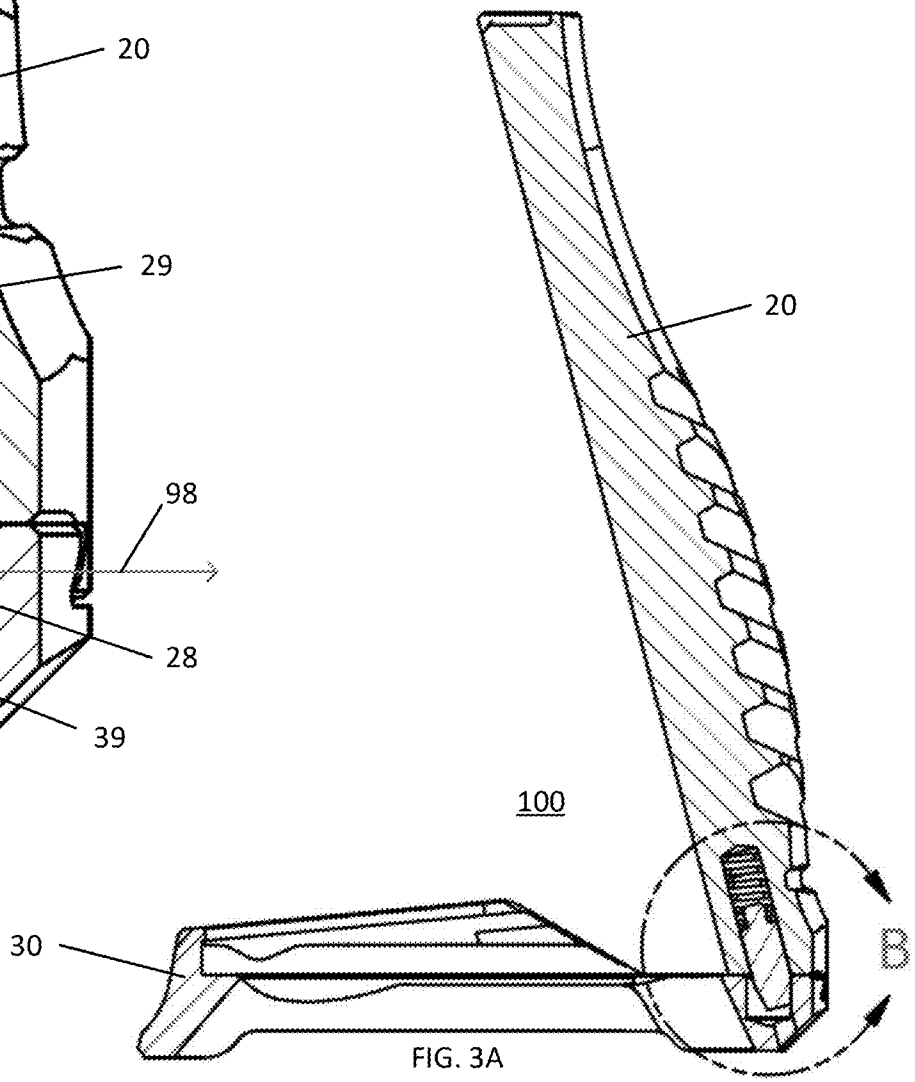
FIG. 3A illustrates a section view of the grip accessory assembly of FIG. 2A, in an assembled state, taken section line A-A.
Figure 3B:
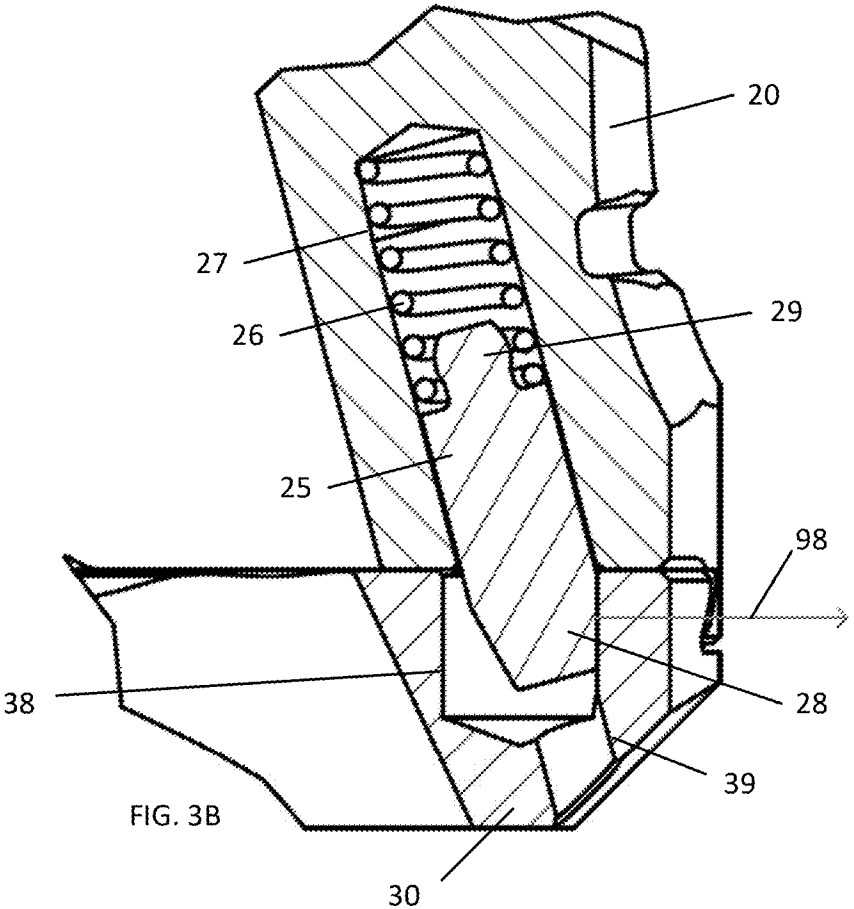
FIG. 3B illustrates a detail B of the grip accessory assembly of FIG. 3A.

Referring now to FIGS. 3A and 3B, when the spring 26 is in a default state (e.g., a state that is less collapsed than the partial collapsing needed to move the magwell 30 forward relative to the backstrap 20), part of the plunger 25 may be located in the hole 38. The hole 38 may be a bore having a vertical sidewall, but this is not required (in other examples, a hole 38 could be a faceted hole with plural flat faces, a hole having a sloped sidewall(s), etc.)

The part of the plunger 25 located in the hole 38 may include a tapered nose 28. An entire length of the taper to make contact with a sidewall of the hole 38, in some embodiments. In the illustrated embodiment, a slope of the taper may be similar to a slope of the hole 27 to provide this contact. In this example, the end of the taper nose is flat; however, this is not required (in one example, the end of the plunger 25 may have a dimple or other depression to receive a push tool inserted into the port 39). Another part of the plunger 25, e.g., an opposite end 29 of the plunger as illustrated, may have an outer diameter that is less than an inner diameter of the spring 26.

The illustrated embodiment of a firearm grip accessory assembly (e.g., magwell 30 and backstrap 20) is compatible with an original SIG P365® X MACRO® grip frame. However, other embodiments of a firearm grip accessory assembly including a magwell having an interface to mate with a corresponding interface of a backstrap may be made compatible with grip frames of any other firearm.

In the illustrated embodiment of an accessory assembly, the separable part of the modular grip assembly is a backstrap. However, in other embodiments, an accessory assembly may include any separable part, now known or later developed, that is mountable with a grip frame of a modular grip assembly.

Although the grip accessory in the illustrated embodiments is a magwell, in other embodiments any grip accessory mounting interface described herein may be used to attach any kind of grip accessory, now known or later developed, to attach to firearm grip.

In the illustrated embodiment, the spring of the plunger assembly is a metal spring. However, this is not required. In various embodiments any type of spring, now known or later developed, may be used in place of the illustrated metal spring. A spring may include any object to generate a spring force, such as any elastic object that stores mechanical energy. Also, any retention device described herein (e.g., a plunger) may be a part that is separable from a spring or may be integrally formed with the spring.

In some embodiments, a grip accessory may retain a separable part on a grip frame (e.g., prevent the separable part from sliding off the grip frame). However, this is not required. The plunger assembly described herein and/or the undercut attachment structures, or any other feature(s) described herein, can be used with a self-retaining separable part (e.g., a separable part retained on the grip frame using its own one or more rotatably driven fasteners). In self-retaining embodiments, it may be possible for the any retention system described herein to retain a grip accessory and/or redundantly retain the separable grip part.

In the illustrated embodiment modular grip assembly includes two separable parts; however, this is not required. In other embodiments, a retention system (e.g., including a spring and a plunger) may be used to retain a single part. In one example, the grip surface of the backstraps described herein may be an integral part of a grip frame. In these embodiments, the protrusion 23 (FIG. 1) and/or the hole 27 may be defined by the grip frame. A separable part having any features of any magwell described herein may be used in combination with such a grip part. This may allow a manufacturer to produce, say, a magwell that is usable with a wide variety of grip frames (e.g., grip frames that have a separable part such as a backstrap, and grip frames in which the grip surface is integrally formed on the grip frame).

Canted Retention System

Some known plunger assemblies are non-canted. For example, U.S. Pat. No. 11,747,100, granted on Sep. 5, 2023 (which is incorporated by reference herein) describes a spring loaded plunger described with respect to FIG. 4B of the '100 patent in which a center axis of the spring and/or the stud is at a right angle with an axis along with the retained part that is slidingly removed (e.g., a center axis of the removable cap described with respect to FIG. 4B of the '100 patent).

Referring again to FIG. 3B of the present application, a canted retention system is used. As illustrated in FIG. 3B, a center axis of the retention system including the spring 26 and the retention device 25 forms an oblique angle with an axis along which at least one of the retained parts (e.g., magwell 30) is slidingly removed. Stated another way, in FIG. 3 the magwell 30 moves along a horizontal axis of the illustration, whereas the plunger assembly moves along an axis that is tilted with respect to a vertical axis of the illustration. A center axis of the hole 27 is also at an oblique angle relative to a center axis of the opening 38 that receives the tapered nose 28.

The tapered nose 28 may have a shape of a truncated cone. As the retained part (e.g., the magwell 30) is pushed along its axis of movement (e.g., along a horizontal axis in this embodiment) by an operator's force, the truncated cone shaped section of the retention device is urged by the spring force into the hole 38. However, the hole 38 has a non-sloped sidewall (e.g., a shape of a cylinder), so the truncated cone shaped section moves downwardly until line contact is provided between the sloped surface of the truncated cone and the non-sloped sidewall of the hole 38 (e.g., a cylindrically shaped bore in this example).

The line contact urged by the canted spring force in turn provides a rearward contact force that urges the retained part (e.g., magwell 30) in a rearward direction (e.g., orthogonal to the center axis of the bore 38, as shown by arrow 98). Furthermore, since the only contact is on a single side (e.g., a rearward sidewall) of the opening 38, all the contact force is in one direction (e.g., a rearward direction in this example). Essentially, once a user pushes the retained part 30 into the illustrated position, the retained part 30 is locked into place. Referring to FIG. 1, this locates the front part of the lip 17 in the front part of the groove 16. This may eliminate the highly noticeable slight "play" that is present in other retention arrangements used in recoil environments (in which a front part of lip on the separable part may not completely locate within a front part of a mating groove on the grip frame even when other parts of the lip are completely located in the mating groove).

Even if the user does not push the retained part 30 all the way (e.g., a few thousands of an inch short), any forward force applied to the separable part will not move the separable part relative to the base due to the plunger. Optimally, any rearward force applied to the separable part during operation or carry will allow the plunger 35 to be urged further into the opening 38, further engaging the retention system and thus further seating a front part of the lip 17 into a front part of the groove 16.

A groove and lip are not required to use the canted retention system described herein. In other embodiments, a base part (e.g., a grip frame) may have a flared section where the separable part may have a ledge to mate with the flared section. The canted retention system may be used in combination with any interface (e.g., an interface for sliding coupling parts), now known or later developed.

A retention system including at least the features of the tapered retention device and the canted spring force described above can be used in any recoil environment to retain one part to another part without requiring a threaded rotatably driven fastener.

Grip Attachment Usable in Modular and Non-Modular Firearm Assemblies

When a firearm provides a modular grip assembly, such as a firearm including a backstrap described with reference to FIG. 1, a threadless region for attaching a grip attachment thereon may be provided on the modular attachment. For example, in the embodiment described in FIG. 1, a slidable attachment interface is provided on the modular attachment (e.g., a protrusion 23 is provided on the backstrap 20, in the illustrated embodiment). A grip attachment (e.g., magwell 30) can then be used in combination with the existing frame (which may be an original frame or an aftermarket frame that is similar to the original frame).

One approach for providing a grip attachment usable with "non-modular" frame would be to replace the existing frame with a new design that incorporates a slidable attachment interface. For instance, it may be possible and practical to provide a new frame that includes a slidable attachment interface similar to the slidable attachment interface of the backstrap 20 of FIG. 1. However, it may be desirable to allow users to utilize a grip attachment in combination with their original frame.

Some embodiments described herein provide a grip attachment that may be used with a wide variety of grip assemblies (e.g., usable with a non-modular frame and any other type of non-modular firearm part). In this approach, a kit of parts may be provided, which allows a user to utilize a grip attachment in combination with an existing frame (even in cases where the existing frame does not have modular features).

Figure 13B:
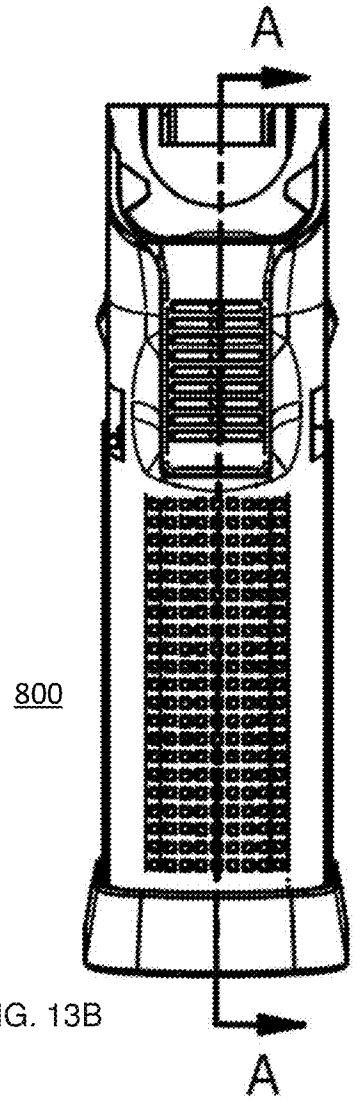
FIGS. 13A and 13B illustrate, respectively, side and rear views of the assembly of FIG. 8A.
Figure 13A:
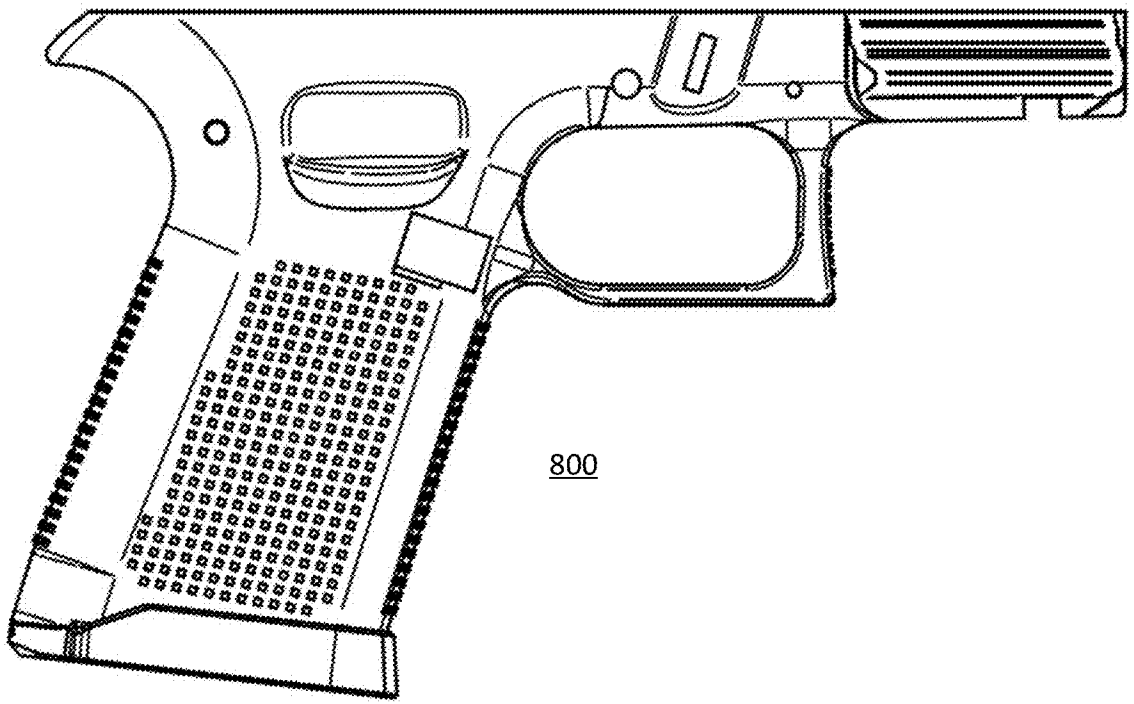
Figure 13C:
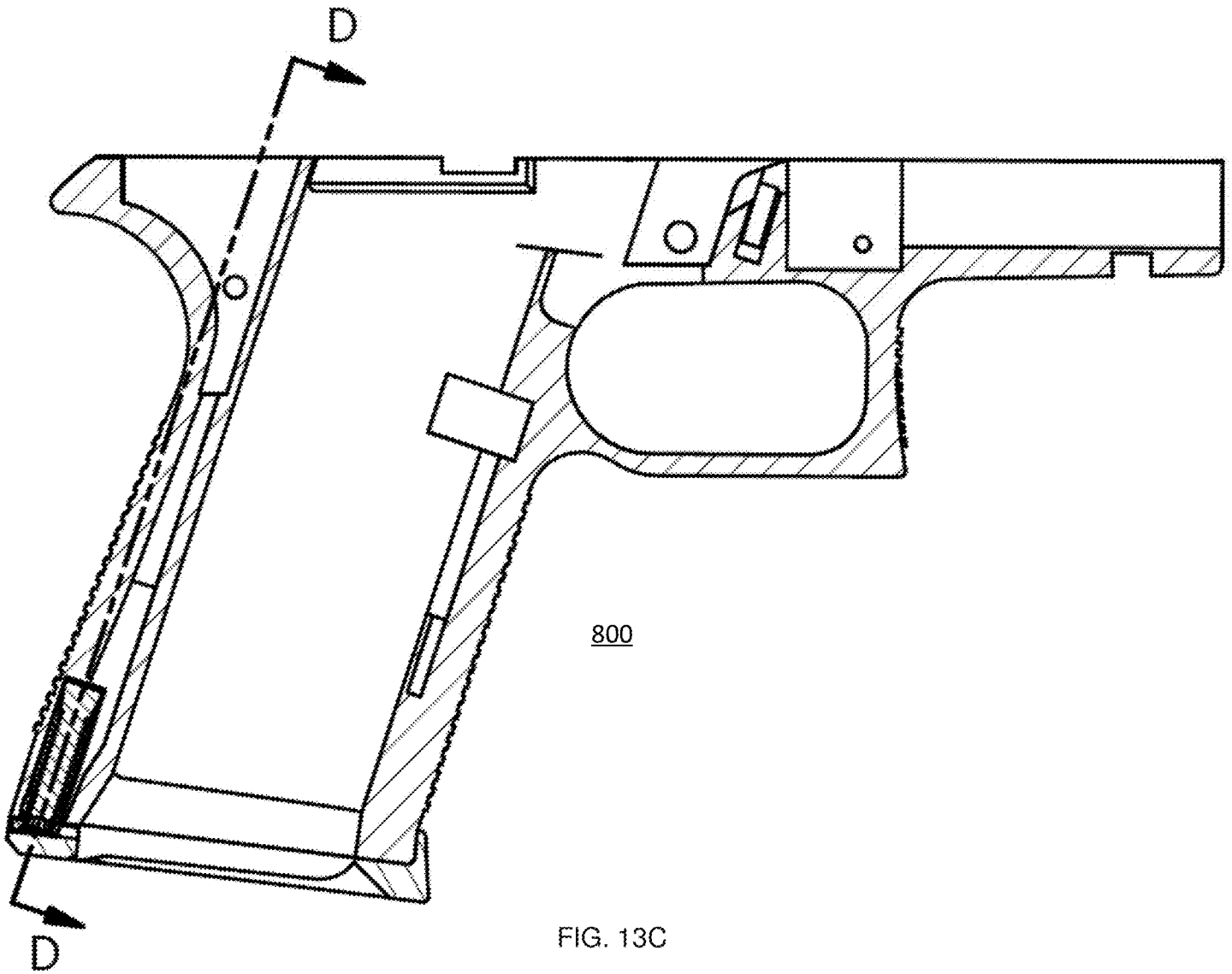
FIG. 13C illustrates a section view taken along section line D-D of FIG. 13B.
Figure 13E:
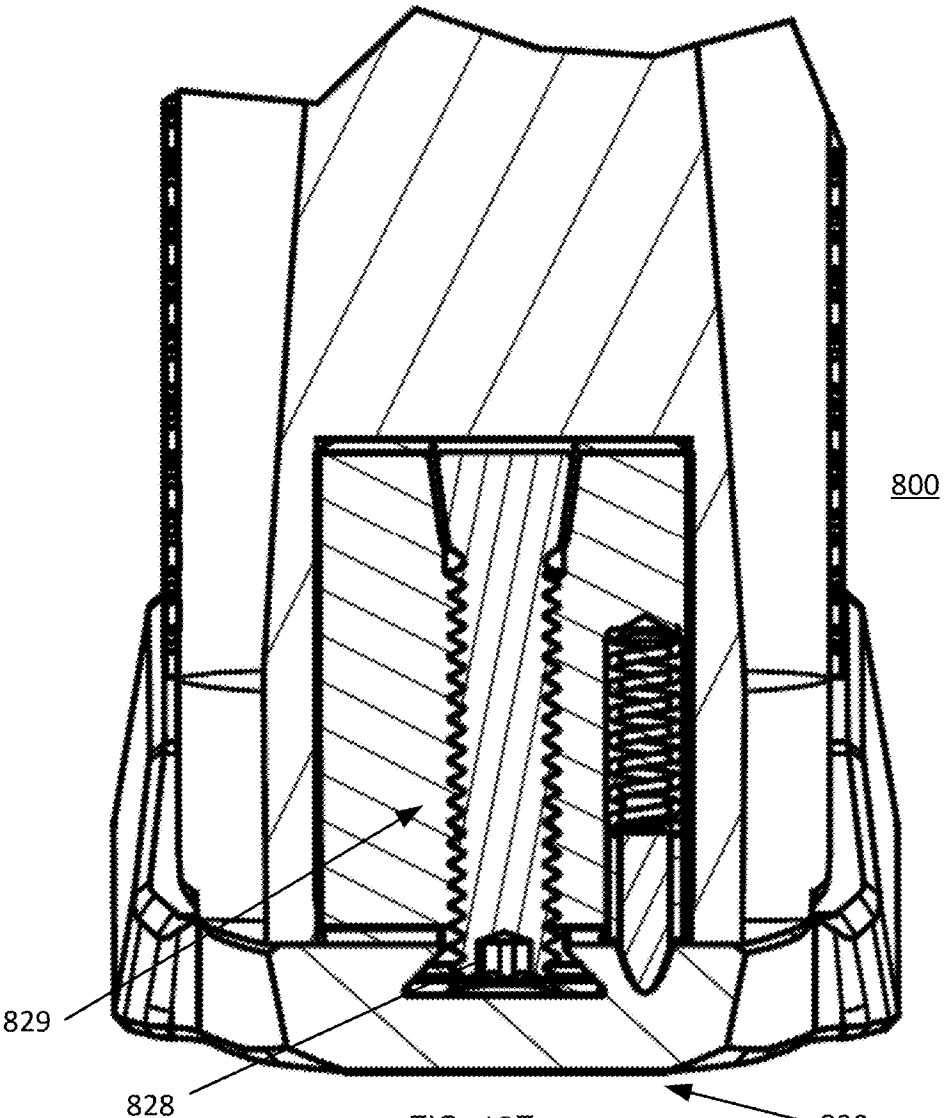
FIG. 13E illustrates a detail E of the section view of FIG. 13D.

Referring briefly to FIG. 13E, a frame without modular features has been retrofitted to include a slidable attachment interface, similar to the slidable attachment interface on the backstrap 20 of FIG. 1. In various embodiments described herein, this retrofit can be completed without drilling, damaging, or otherwise altering the existing frame. Also, in various embodiments a part including the slidable attachment interface may be removably coupled to the existing frame, e.g., a user can couple and uncouple the part including the slidable attachment interface without adhesives, without damaging the existing frame, and/or without damaging the that includes the slidable attachment interface.

It is known that molding, casting, and other manufacturing techniques used to form parts, have various process requirements to ensure a well-formed part (e.g., a well-formed molded part, a well-formed casted part, etc.) These process requirements may include a maximum thickness of material. For example, if a manufacturer attempts to manufacture a frame using molding, the manufacturer ought to provide design features that avoid thick volumes of material. Typically, this is accomplished by providing a hollow. Also, generally speaking, a part that is formed may have one or more other process artifacts of the formation process, such as tool openings to remove manufacturing tooling (e.g., an opening through which the core is pulled out during manufacturing).

It is known that many existing frames typically include at least one of these process artifacts. For instance, looking at the bottom of some frames, one will see, rearward of the magazine well, a D-shaped opening, and a thin wall of material between the D-shaped opening and the magazine well. This "hollow" was provided by the manufacturer's original design to address molding process requirements, and as such it may be referred to herein as a molding process artifact.

Various embodiments described herein provide a kit of parts, which include an expandable body to wedgingly install in a hollow or other process artifact of an existing part such as a frame. This expandable body may provide a point of attachment for a slidable attachment interface, such as a female dovetail or corresponding male feature, a female T-slot or corresponding male feature, or some other undercut opening or corresponding male feature.

The frame having the expandable body installed therein may have one or more threadless regions, including the expandable body's threadless region having the slideable attachment interface. These one or more threadless regions may be used to couple a grip attachment, such as a magwell having a threadless region, to the frame. Due to the use of the threadless regions, like other embodiments described herein, the grip attachment (e.g., the magwell) may remain fixably attached over time (e.g., may not loosen over time as recoil forces are transmitted into the grip frame as well as into other components of the grip assembly, as is observable with some known magwells).

Figure 8A:
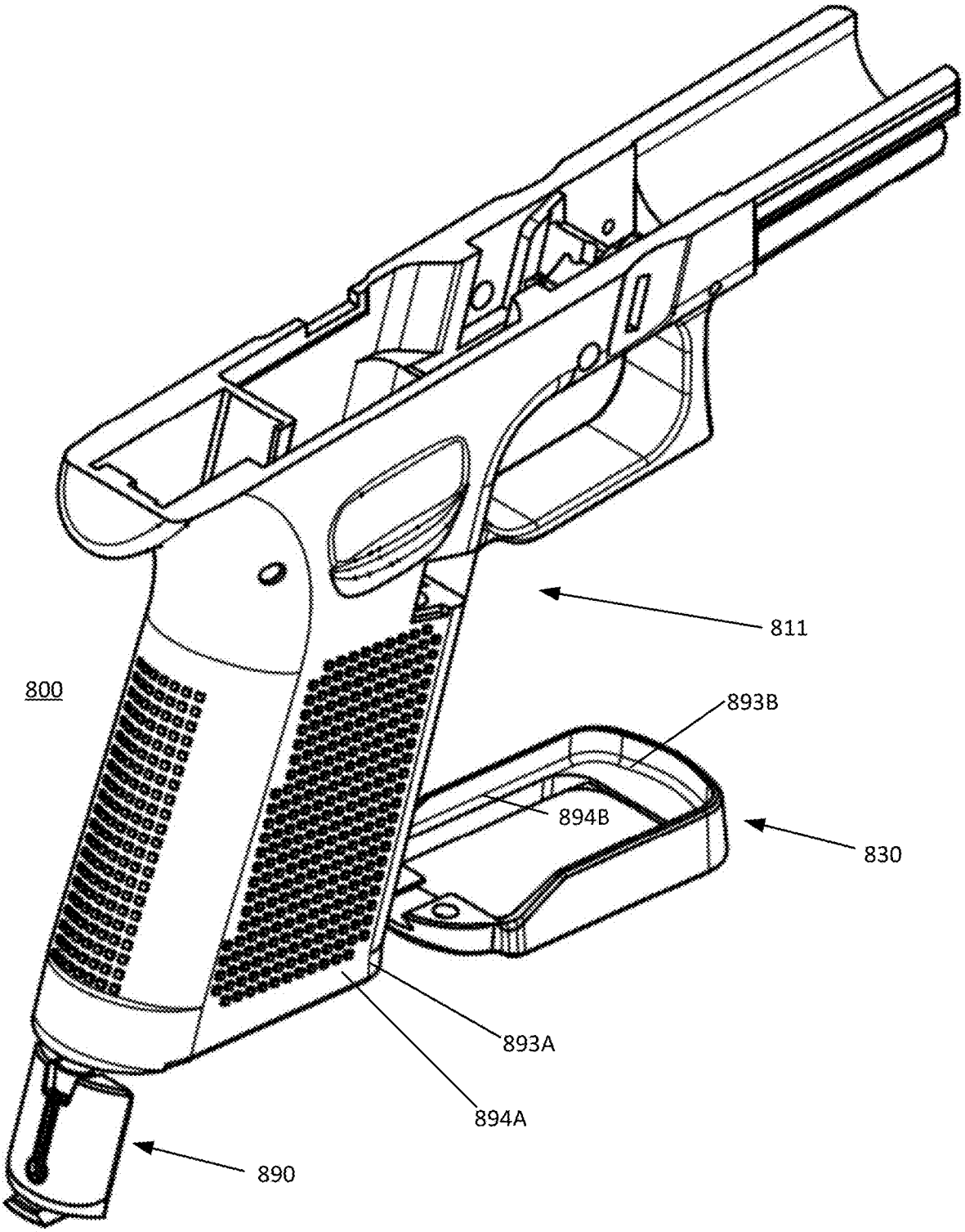
FIG. 8A illustrates an exploded isometric view of another assembly, including a grip attachment (e.g., a magwell) and an expandable body, according to various embodiments.
Figure 8B:
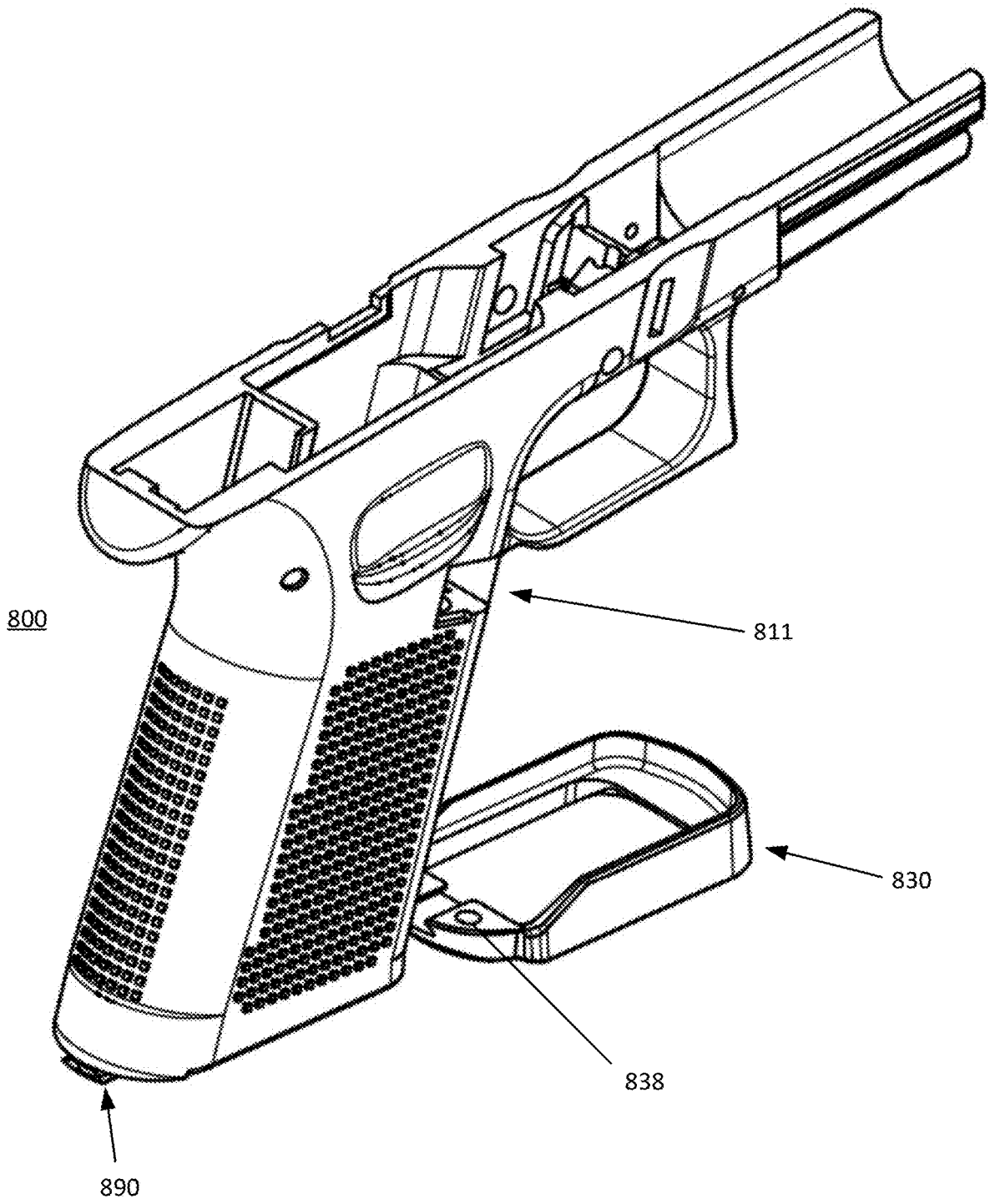
FIG. 8B illustrates an isometric view of the assembly of FIG. 8A, with the grip attachment separated therefrom.

In the embodiment illustrated in FIGS. 8A and 8B, the assembly 800 includes a grip attachment 830 (e.g., a magwell) retained on a grip part 811 using an expandable body 890 (FIG. 8A illustrates an exploded isometric view of the assembly 800, and FIG. 8B illustrates an isometric view of the assembly 800 with the grip attachment 830 separated therefrom).

Figure 9:
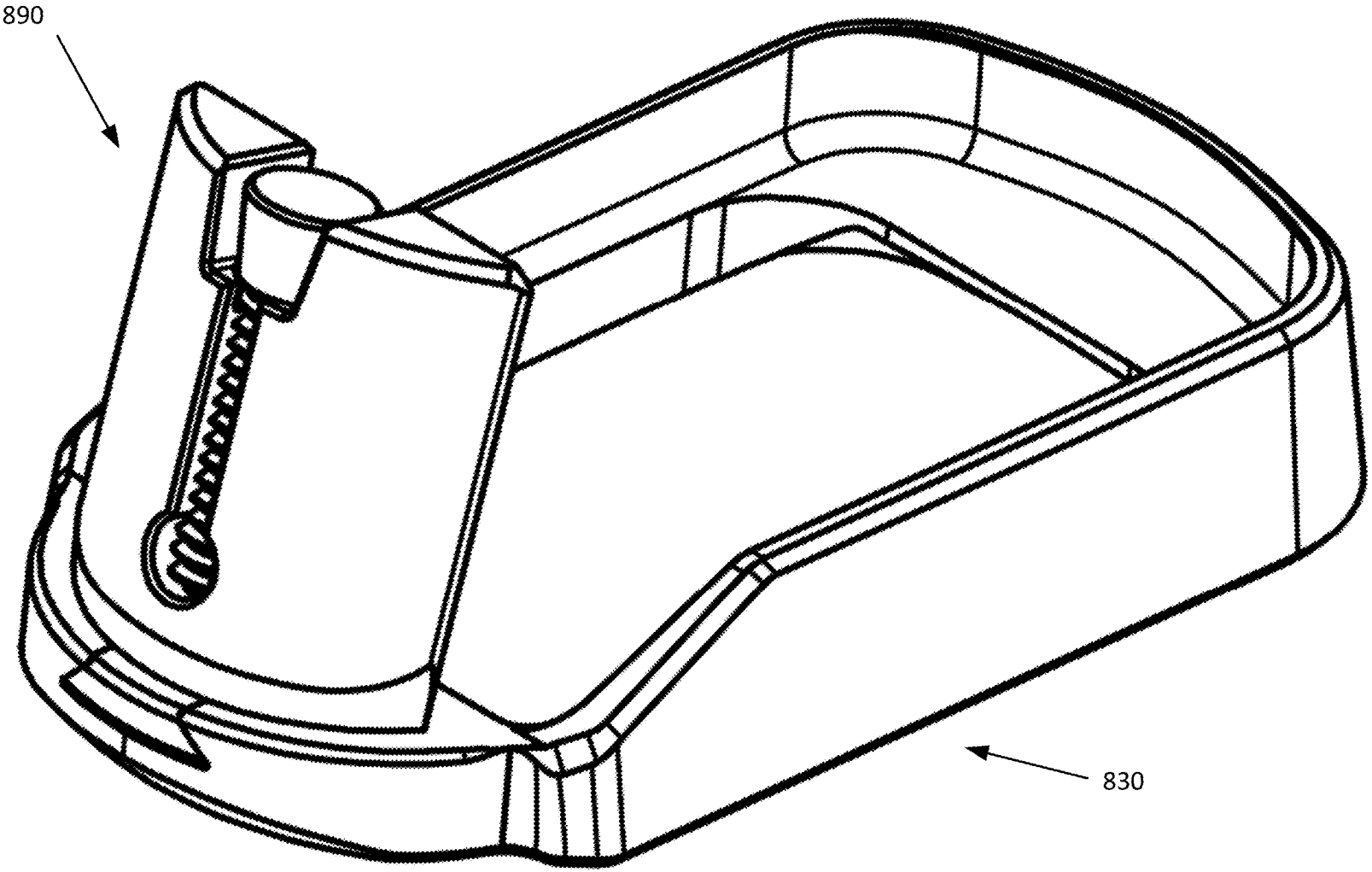
FIG. 9 illustrates an isometric view of the grip attachment of FIG. 8A, with the expandable body removably coupled thereto.

Referring to FIG. 8B, to attach the grip attachment 830 (e.g., the magwell) to the frame 811, an operator/installer may removably couple the expandable body 890 to the frame 811. Then, the operator/installer may slide the grip attachment 830 onto the frame 811 (the frame 811 and the grip attachment 830 may have a sliding attachment interfaces similar to any sliding attachment interfaces described herein). Once the grip attachment 830 is slid on (e.g., into a predefined position), a plunger similar in any respect to any plunger described herein may drop into the plunger into a plunger engagement hole 838 defined by the grip attachment 830. FIG. 9 illustrates an isometric view of the assembly of FIG. 8 in an assembled state without showing the frame 811 (FIG. 8B) for ease of illustration.

To remove the grip attachment 830 (e.g., the magwell), an operator/installer may insert a tool into a tool port (which may be similar to the tool port described with reference to FIG. 3B herein, but is not visible in the views of FIGS. 8A-B), which allows the operator/installer to slidably remove the grip attachment 830 off the frame 811. The operator/installer may also uninstall the expandable body 890 from the cavity, if desired, using opposite steps as installation.

Figure 10A:
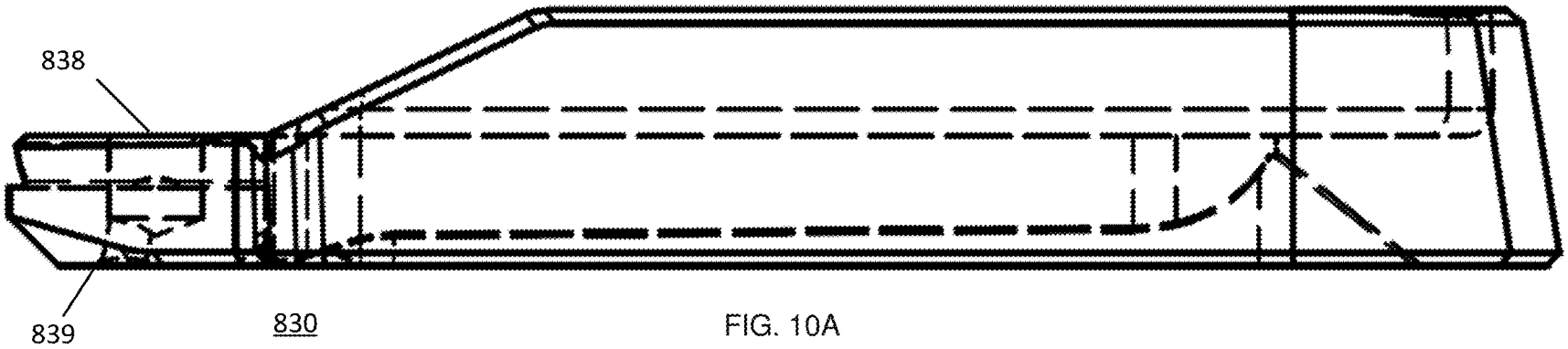
FIG. 10A illustrates a side view of the grip attachment of FIG. 8A.
Figure 10B:
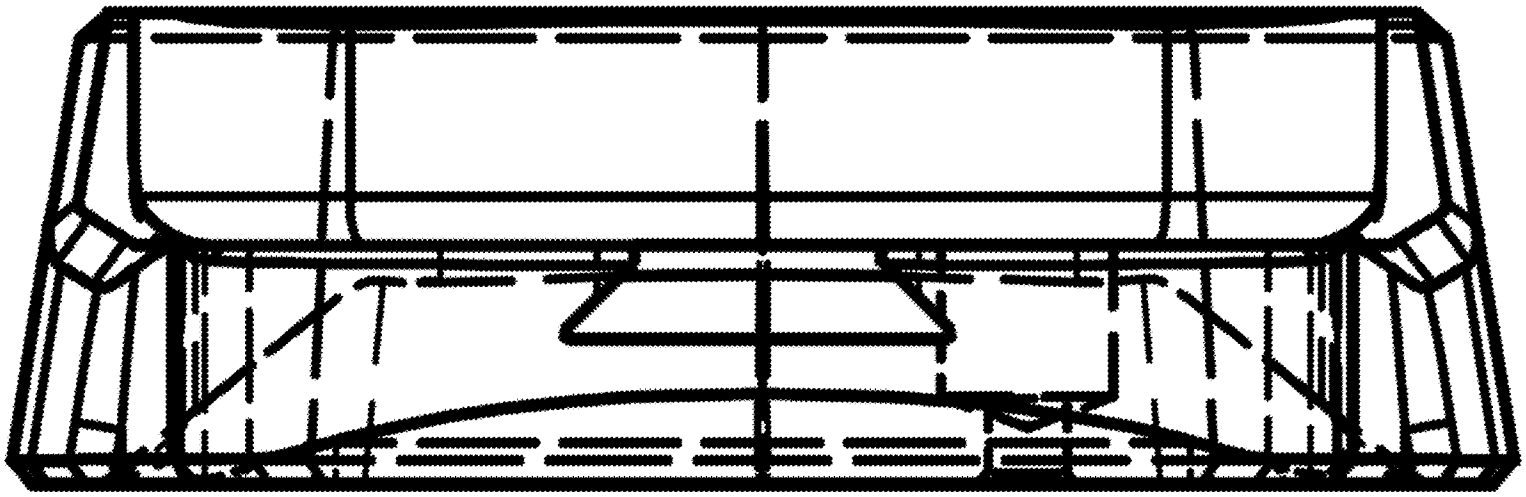
FIG. 10B illustrates a rear end view of the grip attachment of FIG. 8A.

FIG. 10A illustrates a side view of the grip attachment 830 of FIG. 8A. FIG. 10B illustrates a rear end view of the grip attachment 830 of FIG. 8A. The tool access port 839 is illustrated in FIG. 10A. In this example, the tool access port 839 is canted at an angle similar to a cant of any canted retention system described herein. However, the tool access port 839 may be canted in a different amount, or not canted, in other examples.

Figure 11A:
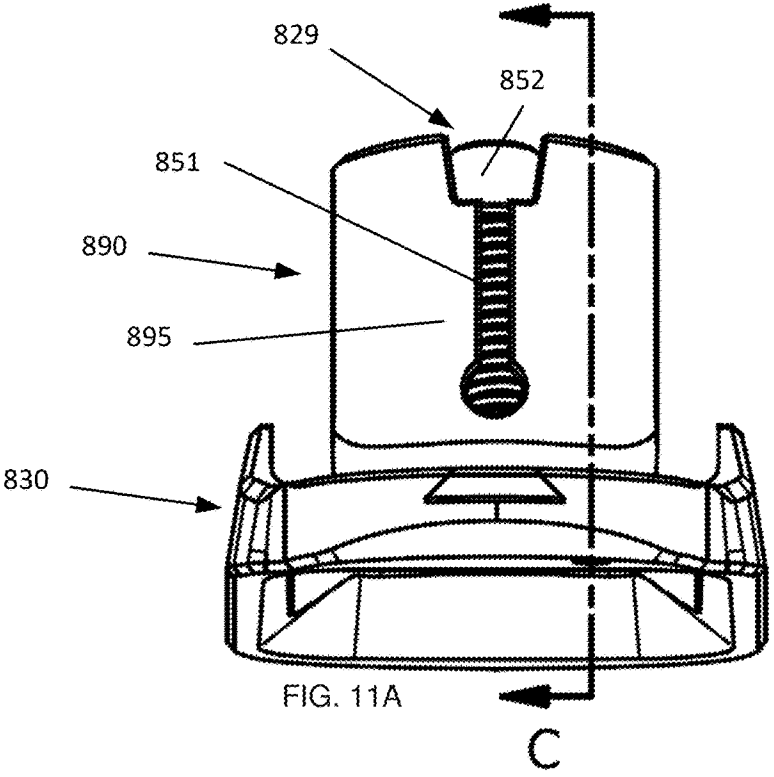
FIG. 11A illustrates a rear end view of the grip attachment illustrated in FIG. 9, in which the expandable body is coupled thereto.
Figure 11B:
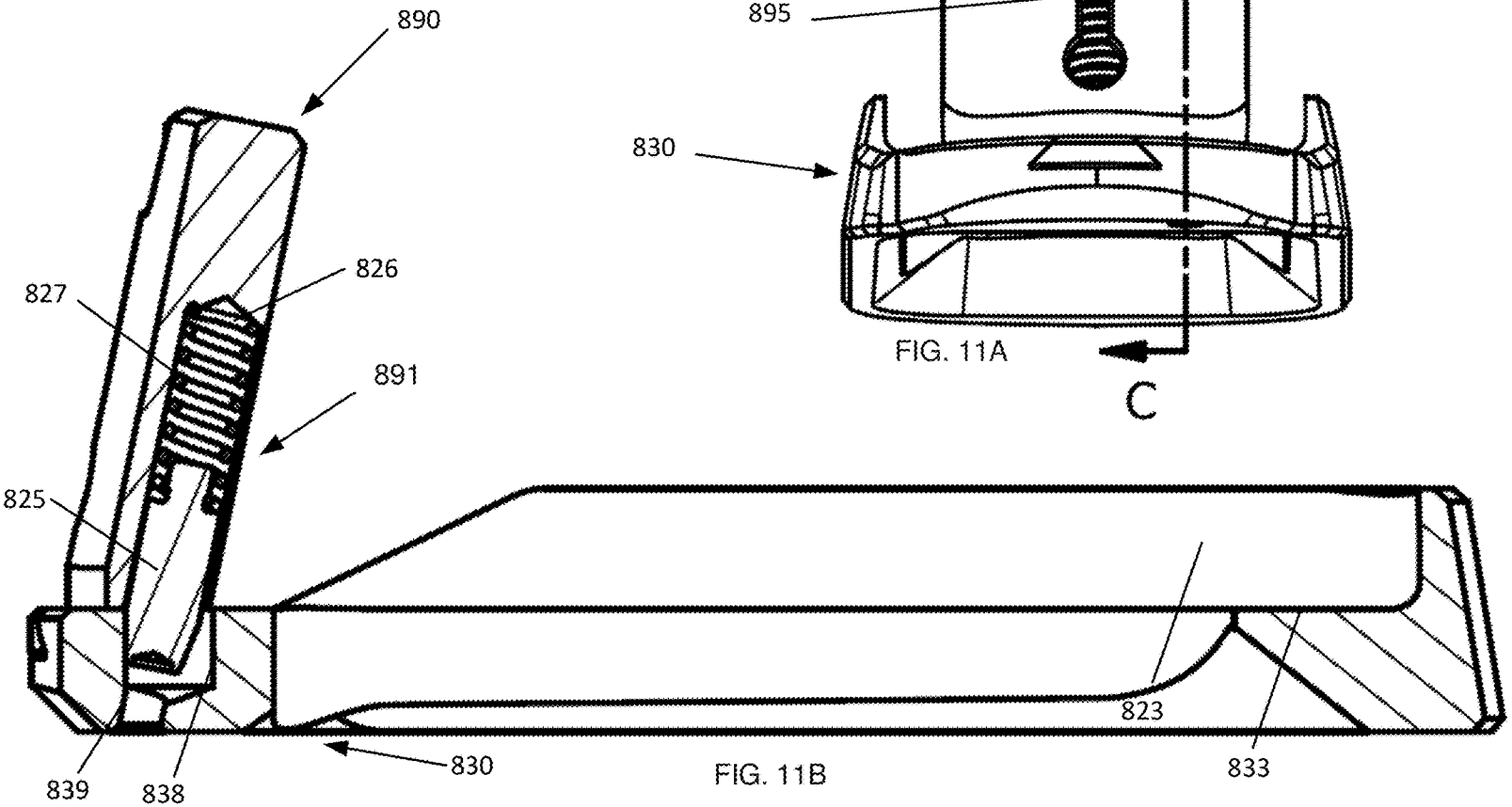
FIG. 11B illustrates a section view taken along section line C-C of FIG. 11A.
Figure 12B:
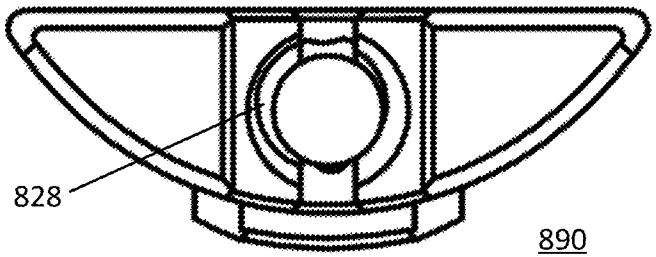
FIGS. 12B and 12C illustrate, respectively, top and bottom views the expandable body of FIG. 12A in isolation.
Figure 12C:
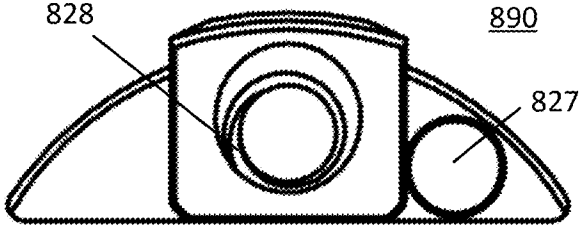
Figure 12A:
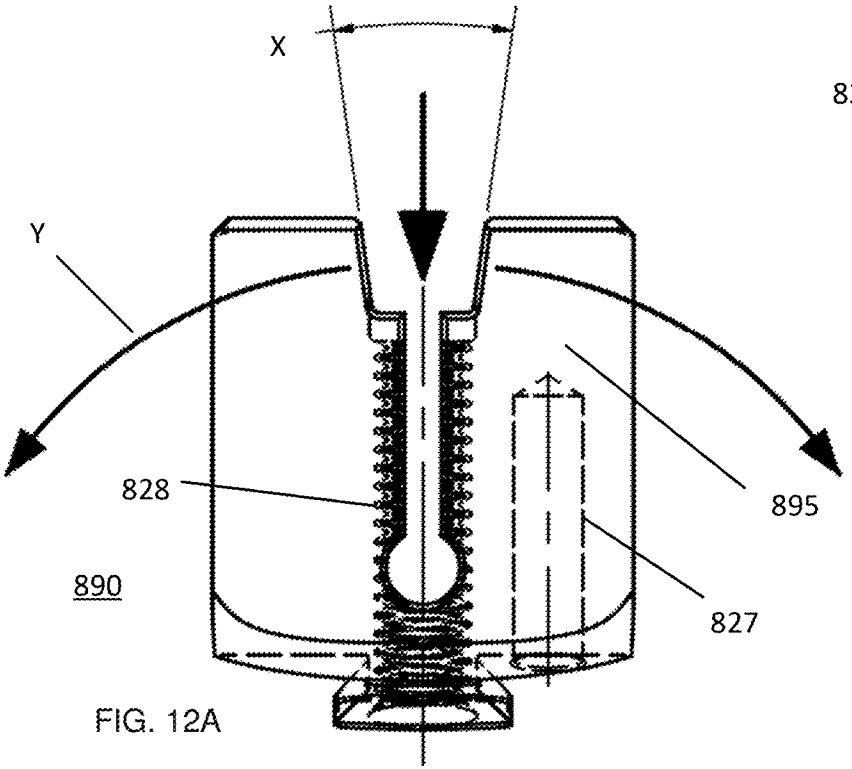
FIG. 12A illustrates a back side view of a body of the expandable body of FIG. 8A.

FIG. 11B illustrates a section view taken along section line C-C of FIG. 11A. FIG. 12A illustrates a back side view of the expandable body 890 of FIG. 8A. In this illustration, a canted retention system 891 is shown. This canted retention system 891 may be similar in any respect to any canted retention system described herein, and may include retention system cavity 826 for the spring 827 and the plunger 825. An engagement section of the plunger 825 may be located in the retention engagement hole 839 when the grip attachment 830 is installed onto the frame (not shown). The entire plunger 825 may be located in the retention system cavity 826 before the grip attachment 830 is slide into the predefined position.

Referring now to FIG. 11A, the expandable body 890 may carry a rotatably threaded retention part 829 having a threaded section 851 and a wedge section 852 to open up an expanding part 895 of the expandable body 890 when the rotatably threaded retention part 829 is tightened. In this embodiment, the wedge section 852 is in the form of a head. A drive section (not shown) of the rotatably driven part 829 may be on an opposite end of the rotatably threaded retention part 829 as the wedge section 852. The rotatably threaded retention part 829 is shown in more detail in FIGS. 14A and 14B, where it can be seen that a drive section 828 (e.g., a socket for a socket tool) is located on a bottom of the rotatably threaded retention part 829 (opposite the wedge section 852).

The tapered head 852 provides a self-locking function, besides providing the wedging function. As described in more detail in the '451 application, a tapered head of a rotatably-driven retention part (e.g., a screw) may prevent the rotatably-driven part from backing out over time due to recoil forces. Although the tapered head 852 may be sufficient to prevent the threaded length 852 from backing out over time to recoil forces, it may be possible and practical to also utilize additional self-locking features, such as the self-locking threads described in the '451 application, instead of, or in addition to, a tapered head.

With reference again to FIG. 8A, often frames include one or more contour features, such as flare out at the bottom and/or a front lip, for reasons that may be entirely separate from attaching a grip attachment. In various embodiments, at least one of these contour features may be utilized as one of the threadless regions. In this illustration, the one or more contour features include the front lip 893A and the side flares 894A (only one of the side flares 894A is observable in this view). The grip attachment 830 (e.g., the magwell) includes an interior sections 893B and 894B (e.g., channels, pockets, or the like) to receive the front lip 893A and the side flares 894A, respectively, when the grip attachment 830 is in the predefined position (where the plunger engagement occurs). This additional attachment interface does not utilize any threads, does not require a new frame, and contributes to retention of the grip attachment 830 on the frame 811 (e.g., operates with the dovetail, T-slot, or other undercut interface to retain the grip attachment 830 on the frame 811).

FIG. 12A illustrates a back side view of a body 895 of the expandable body of FIG. 8A, in isolation. FIGS. 12B and 12C illustrate, respectively, top and bottom views of the expandable body of FIG. 12A, in isolation. In these views, one can observe a threaded through opening 828 to receive the threaded section of the rotatably driven part 829, and a tapered opening to receive the wedge section 852 of the rotatably driven part 829. In this example, the value 'X' may be 16 degrees, but in other embodiments the value X may be any value to provide loosening resistance from recoil, or any other value.

The arrows Y illustrate how the expanding section 895 may open up (by flexing) as the tapered head 852 is driven into the tapered opening. A control feature (e.g., the illustrated circular opening and/or the illustrated elongated opening) may allow the expanding section 895 to expand with less total force, and/or may restrict or prevent another section of the expandable body 890 from expanding.

Figure 13D:
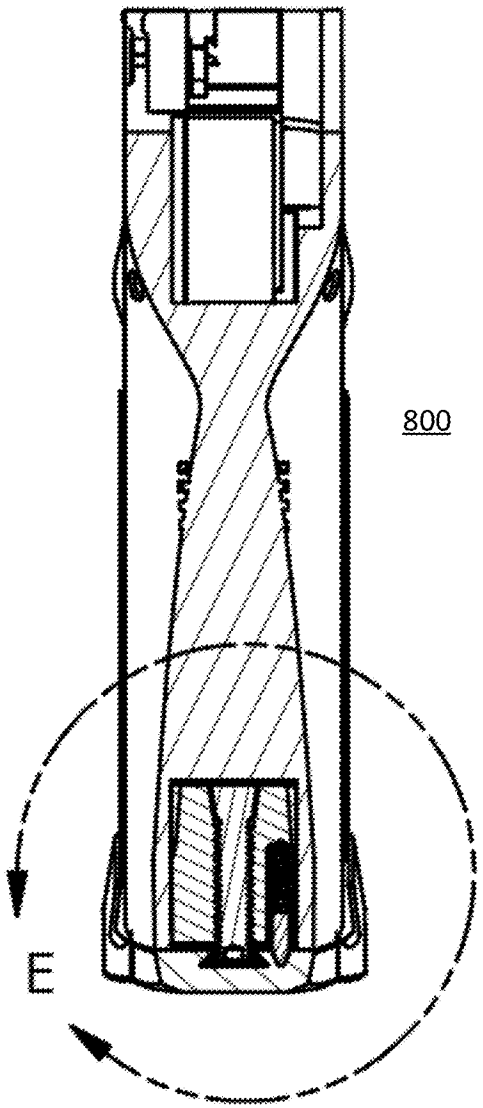
FIG. 13D illustrates a section view taking along section line E-E of FIG. 13C.
Figure 14B:
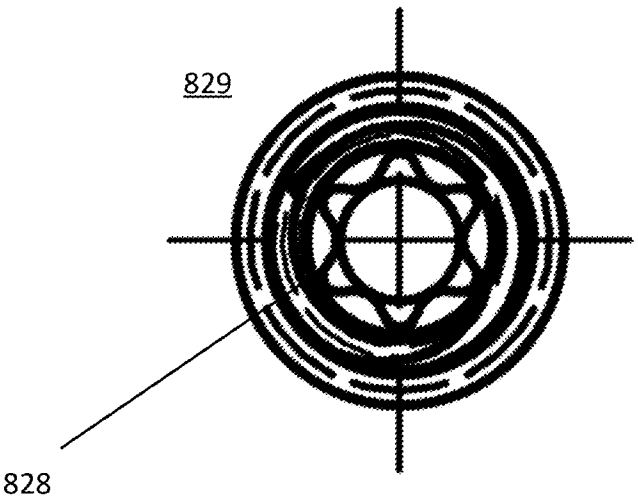
FIGS. 14A and 14B illustrate, respectively, side and bottom views of the retaining part of FIG. 8A.
Figure 14A:
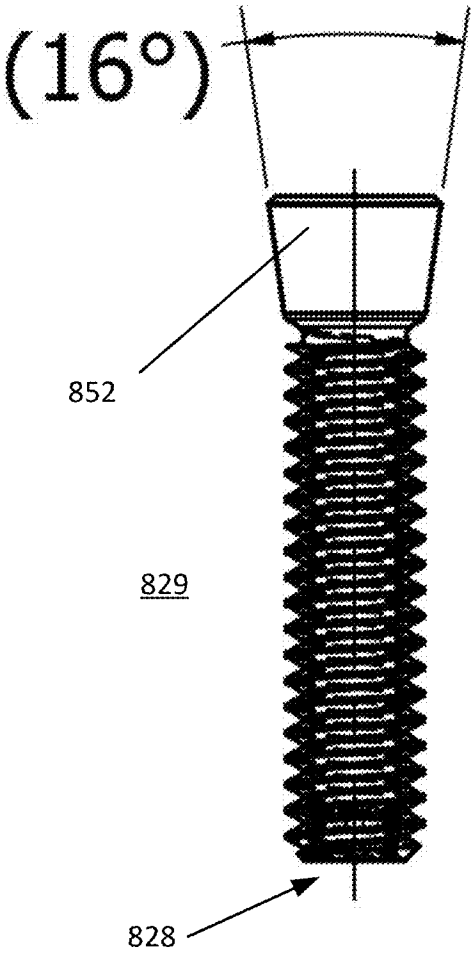

FIGS. 13A and 13B illustrate, respectively, side and rear views of the assembly 800 of FIG. 8A. FIG. 13C illustrates a section view taken along section line D-D of FIG. 13B. FIG. 13D illustrates a section view taking along section line E-E of FIG. 13C. FIG. 13E illustrates a detail E of the section view of FIG. 13D. FIGS. 14A and 14B illustrate, respectively, side and bottom views of the retaining part 829 of FIG. 8A.

Referring to FIG. 13E, unlike some known grip assemblies in which an end (e.g., a driving end) of at least one rotatably driven fasteners is exposed (e.g., at least one screw head is exposed), restricting where grip features may be placed by a designer (if the designer does not want to accept the discomfort of co-locating grip features and exposed rotatably driven fastener surfaces), the ends of the rotatably driven fastener 829 are not exposed. In particular, a driving feature 828 corresponding to a drive section of the rotatably driven (e.g., a socket opposite the head end of the rotatably driven fastener 829) is not exposed. In this example, the grip attachment 830 covers the rotatably driven fastener 829 (e.g., covers the driving feature 828).

Referring to FIG. 14A, the rotatably driven fastener 829 is shown in isolation. It includes the wedge section 852, and the drive section 828. In this embodiment, the threaded length of the rotatably driven fastener 82 is located between the wedge and drive sections 852 and 828, but this may not be required in other embodiments.

Figure 15:
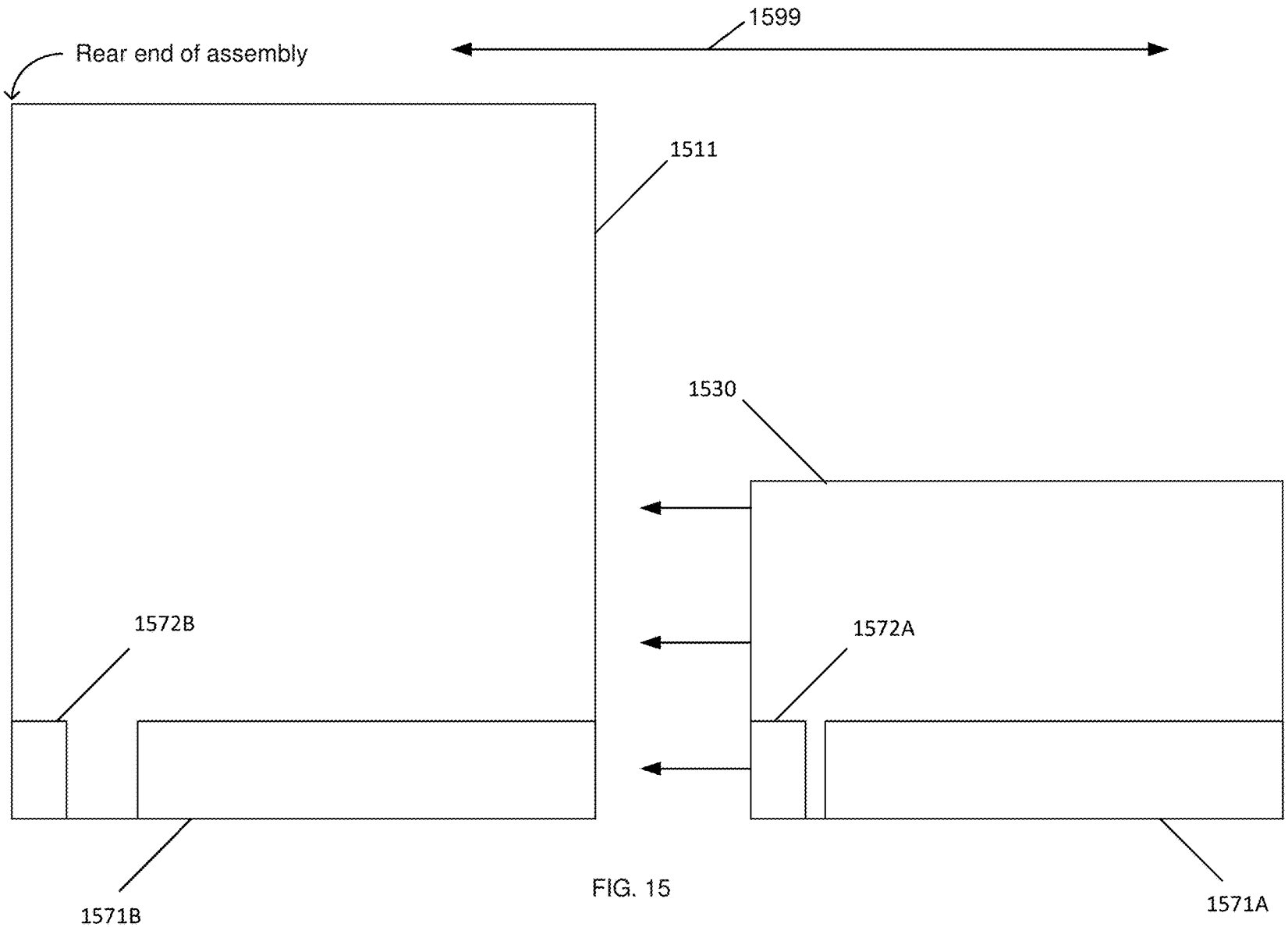
FIG. 15 is a schematic diagram illustrating an attachment for a recoil environment (e.g., a grip attachment) having a slidable attachment interface to restrict coupling movement of the attachment to longitudinal movement (e.g., fore/aft movement) and an additional interface to restrict an longitudinal position (e.g., fore/aft position) of the attachment, according to various embodiments.

FIG. 15 is a schematic diagram illustrating an attachment 1530 for a recoil environment (e.g., a grip attachment) having a slidable attachment interface 1571A to restrict coupling movement of the attachment 1530 to longitudinal movement (e.g., fore/aft movement and/or axial movement) and at least one additional interface 1572A to restrict a longitudinal position (e.g., fore/aft position and/or an axial position) of the attachment 1530, according to various embodiments.

The attachment 1530 may be similar in any respects to any grip attachment described herein (e.g., any magwell described herein). The device 1511 may be any part to operate in a recoil environment, such as:

- An assembly having modular grip features, for example, with reference to FIG. 1: the assembly of the frame 11, a modular grip part (e.g., the backstrap 20), etc.;
- An assembly including an existing frame, which may be non-modular or modular, retrofitted using a kit of parts, such as one including an expandable body similar in any respect to any expandable body described herein, or some other kit of parts for retrofitting an existing frame;

One or more parts with or without modular grip features, for example, a new frame having a slidable attachment interface similar to any slidable attachment interface described herein, in which the slidable attachment interface is integrally formed on the new frame, removably coupled to the new frame, non-removably coupled to the new frame, or the like; and/or Some other assembly or part, now known or later developed, to operate in a recoil environment.

The attachment 1530 may include a slidable attachment interface 1571A and at least one additional interface 1572A. The slidable attachment interface 1571A may restrict a coupling movement of the attachment 1530 relative to the device 1511, to longitudinal movement The slidable attachment interface 1571A may restrict the coupling movement to fore/aft movement. For instance, an axis 1599 may be a bore axis of a firearm, which of course may extend from a muzzle end of the firearm to an opposite end of the firearm. The longitudinal movement may be parallel to axis 1599, and in the illustrated embodiments the attachment 1511 may be slide rearwardly for attachment and forwardly for removal. In other embodiments, the longitudinal movement may be along an axis that may be not parallel with the bore axis, for example, an axis along any plane.

The at least one additional interface 1572A may restrict a longitudinal position (e.g., a fore/aft positon or other axial position) of the attachment 1530 relative to the device 1511. The at least one additional interface 1572 may include part of any retention system described herein.

In some examples, the retention system may be a canted retention system similar in any to the canted retention systems described herein. In these examples, the canted retention system may include a plunger or other retaining and a spring to urge the plunger or retaining part into hole and/or or against an engagement feature. The plunger or other retaining part may travel along a path of movement that is at an oblique angle with respect to the plane and/or the longitudinal movement of the attachment 1530. When the longitudinal movement of the attachment 1530 is parallel with the axis 1599, the path of movement may also be at an oblique angle with respect to the axis 1599.

The device 1511 may have a slidable attachment interface 1571B operable with the slideable attachment interface 1571A. In various examples, one of these interfaces 1571A-B may include an undercut opening (e.g., a female dovetail, T-slot, or other undercut opening now known or later developed) and the other of these interfaces 1571A-B may include a protrusion receivable by the undercut opening (e.g., a male dovetail, T-slot, or other male feature receivable by the undercut opening).

The device 1511 may have an additional interface 1572B operable with the slidable attachment interface 1572A. In various examples, one of these interfaces 1572A-B may include a retention system cavity to hold any retention system described herein, and the other of these interfaces 1571A-B may include a hole or other engagement feature that a plunger or other retaining part of the retention system may engage to restrict a longitudinal position or other axial position of the attachment 1530 relative to the device 1511. Although it is not shown in this schematic illustration, the attachment 1530 of course may have any other additional interface described herein, such as the openings (e.g., channels or pockets) to receive one or more contour features, or some other part, of the device 1511. The one or more contour features may be original features of the device 1511.

In some examples, the device 1511 may be a part of a firearm without modular features (e.g., without modular grip features), such as a frame, or may be an assembly of a firearm with modular grip features, such as an assembly of a frame and a backstrap. When the device 1511 includes an expandable body (removably or otherwise attached thereto, for retrofitting the frame or some other reason) a rotatably driven part with threading may drive expansion of an expanding section of the expandable body. However, a drive section of that rotatably driven part may be covered by the attachment. Also, the rotatably driven part may be include a tapered head, or some other tapered section, to prevent the rotatably driven part from loosening due to recoil forces (and/or may include self-locking threading)

When the device 1511 includes modular features, it may be preferable to retrofit by providing a new modular part that defines the retention system cavity or hole/engagement feature. For instance, referring to the embodiment illustrated in FIG. 1A, the frame 11 may be provided with the backstrap 20, which provides a retention system cavity 27 or hole/engagement feature. This enables the original based component (e.g., the frame 11) to be retained in the firearm. However, this is not required—in various examples any expandable body described herein may be used in combination with a modular grip assembly in order to keep a preexisting modular part (such as a preexisting backstrap).

As mentioned previously, when the device 1511 does not include modular features, there may be no modular part. It may of course be possible to simply replace the original frame to provide a retention system cavity or hole/engagement feature integrally formed, or otherwise include on a new frame. However, when the original frame is manufactured by molding or casting, it may be possible to retain the original frame. For instance, some frames include a magazine well and a D-shaped hole, separated by a thin wall (e.g., part of the magazine well may be defined by a forward side of the thin wall and part of the D-shaped hole may be defined by a rear side of the thin wall). The frame 811 illustrated in FIG. 8A is one such example (one or ordinary skill in the art would be familiar with this D-shaped hole, even though it is not shown in this view). This D-shaped hole is an artifact (e.g., a molding process artifact) because its existence is driven by molding process requirements (the D-shaped hole's original purpose was to avoid molding defects.

This molding artifact may be enable utilization of the attachment 1530 in combination with the original frame. In particular, a body defining a retention system cavity or hole/engagement feature may be mounted into this D-shaped hole. In the embodiment illustrated in FIG. 8A, the body 890 is wedgably couple to the frame 811 by inserting the body 890 in the D-shaped hole and then expanding the body (the expansion is indicated in FIG. 12A). This effectively retrofits an original frame to be operable with the attachment 1530. Of course, a similar approach can be used to with an aftermarket frame having its own process artifact (e.g., a molding process artifact or a casting process artifact).

It may be preferable to retrofit a modular frame by providing a new modular part that defines the retention system cavity or hole/engagement feature. For instance, referring to the embodiment illustrated in FIG. 1A, the frame 11 may be provided with the backstrap 20, which provides a retention system cavity 27 or hole/engagement feature. This enables the original based component (e.g., the frame) to be retained in the firearm, in combination with the new modular part, and the attachment 830.

It should be understood that a firearm assembly may include both a modular part, such as a backstrap, and any expandable body described herein. This may allow a user to retain their original backstrap and original frame, in combination with new attachment such as a magwell.

We claim all modifications and variations coming within the spirit and scope of the following claims.

The invention claimed is:

1. A grip attachment having a threadless region to couple to one or more corresponding threadless regions of at least a portion of a grip, the threadless region of the grip attachment comprising:

a slidable attachment interface to restrict a coupling movement of the grip attachment relative to the at least the portion of the grip to a fore/aft movement, wherein the coupling movement is along a plane; and an additional interface associated with a spring-biased part, the additional interface to restrict a fore/aft position of the grip attachment relative to the at least the portion of the grip;

the additional interface configured to constrain the spring-biased part to movement along an axis of movement, wherein the axis of movement is not parallel with the plane.

2. The grip attachment of claim 1, wherein the slidable attachment interface is defined by at least one interior surface of the grip attachment, the at least one interior surface to engage part of a flare or lip defined by a threadless region of the one or more threadless regions of the at least the portion of the grip;

wherein the flare or lip is located proximate to 1) sides of a bottom end of the at least the portion of the grip, or 2) a front of the bottom end of the at least the portion of the grip.

3. The grip attachment of claim 1, wherein the grip attachment comprises a magazine guide for loading a magazine into a magazine well of the at least the portion of the grip; and wherein the at least the portion of the grip is part of a frame.

4. The grip attachment of claim 1, wherein the slidable attachment interface comprises a dovetail interface.

5. The grip attachment of claim 1, wherein the slidable attachment interface comprises a male feature or a female feature of:

a dovetail interface;

a T-slot interface; or other undercut interface.

6. The grip attachment of claim 1, wherein the additional interface comprises an engagement hole to receive a portion of the spring-biased part in response to the grip attachment being slid onto the at least the portion of the grip.

7. A body defining a threadless region, of the one or more threadless regions, to couple to the threadless region of the grip attachment of claim 1, wherein the body defines a male feature or a female feature corresponding, respectively, to a female feature or a male feature defined by the slidable attachment interface;

wherein the spring-biased part comprises a plunger, and wherein one of the grip attachment or the body defines a plunger engagement hole to receive a portion of the plunger protruding from a plunger cavity, and the other of grip attachment or the body defines the plunger cavity.

8. The body of claim 7, wherein the body includes a threaded hole, the threaded hole to receive a threaded part, the threaded part including a wedge section to expand the body to retain the body in a molding process artifact or casting process artifact, or other recess of a molded or casted body of the at least the portion of the grip.

9. The body of claim 8, wherein the threaded part includes 1) a first terminal end defined by, or adjacent to, the wedge section, 2) a threaded length, and 3) a second opposite terminal end;

the threaded hole comprises a threaded through hole; and the second terminal end defines a drive interface to rotationally to drive expansion of the body, using the wedge section.

10. The body of claim 9, wherein the grip attachment covers the drive interface when the additional interface restricts the fore/aft position of the grip attachment relative to the at least the portion of the grip.

11. The grip attachment of claim 1, wherein the one or more threadless region comprises threadless regions, the grip attachment further comprising:

a canted retention system mounted in, or on, one of the threadless regions, the canted retention system including a spring to urge the spring-biased part along an axis of movement into an opening defined by a different one of the threadless regions; and wherein the axis of movement is at an oblique angle with respect to the plane.

12. The grip attachment of claim 11, wherein the opening comprises a first opening, and wherein the canted retention system is located in a second opening defined by the one of the threadless regions;

wherein a center axis of one of the first and second openings is canted with respect to a center axis of the other one of the first and second openings.

13. The grip attachment of claim 11, the spring to urge at least part of a tapered section of the spring-biased part into the opening, wherein a width of the opening is larger than a width of a widest part of the tapered section.

14. The grip attachment of claim 11, wherein the spring-biased part includes a conical nose or other sloped section, the spring to urge at least part of the conical nose or other sloped section into the opening.

15. The grip attachment of claim 14, wherein the conical nose or the other sloped section has a shape of a truncated cone, including an end with a flat or curved face to receive a contact force to at least partially collapse the spring, to release the grip attachment from the at least the portion of the grip.

16. A kit of parts for a recoil environment, the kit of parts comprising:

a retention system including a spring-biased part; and a grip attachment, releasably mountable to at least a portion of a trigger hand grip using the retention system, the grip attachment, defining a section, to receive, or engage, the spring-biased part;

wherein the section includes a hole or at least one surface, the spring to urge the spring-biased part into the hole, or against the at least one surface; and wherein when the grip attachment is releasably attached to the at least the portion of the trigger hand grip using the retention system the spring-biased part is constrained to movement along an axis of movement, and:

1) the axis of movement intersects a plane that intersects front and rear ends of the at least the portion of the trigger hand grip, or 2) a portion of the retention system urges the grip attachment in a direction that is parallel with the plane.

17. The kit of parts of claim 16, further comprising:
a backstrap other modular part to couple to the at least the portion of the trigger hand grip, or
an expandable body configured to install in a cavity defined by the at least the portion of the trigger hand grip; and
a retention system cavity to hold the retention system, the retention system cavity defined by 1) the at least the portion of the trigger hand grip 2) the backstrap or other modular part, or 3) the expandable body.

18. The kit of parts of claim 17, wherein the spring-biased part includes:
an engagement section urgable into the hole, or against the at least one surface; and
wherein at least a portion of the engagement section retracts into the retention system cavity when the spring is at least partially collapsed.

19. The kit of parts of claim 17, wherein a back of the backstrap or other modular part forms the trigger hand grip together with the at least the portion of the trigger hand grip.

20. The kit of parts of claim 16, further comprising an undercut opening and a protrusion to couple into the undercut opening;
the grip attachment defining one of the undercut opening and the protrusion, the at least the portion of the trigger hand grip defining the other of the undercut opening and the protrusion.

21. An apparatus to operate in a recoil environment, the apparatus including:
an attachment configured to slidably couple to a firearm, the attachment including a threadless region to couple to one or more corresponding threadless regions of at least one part:
wherein the attachment includes:
a slidable attachment interface to restrict a coupling movement of the attachment relative to the at least one part, to a fore/aft movement, wherein the coupling movement is along a plane, wherein the slidable attachment interface comprises a male feature or a female feature of:
a dovetail interface;
a T-slot interface; or
another undercut interface; and
an additional interface associated with a separable part, the additional interface to restrict a fore/aft position of the attachment relative to the at least one part;
wherein the separable part includes terminal ends and a length, the separable part including a sloped surface on one side of the length and another surface on an opposite side of the length; and
the separable part to urge the attachment in a direction that is parallel with the plane, wherein when the attachment is urged by the separable part 1) at least a portion the sloped surface is in contact with the attachment and 2) a corresponding at least a portion of the other surface is not in contact with the attachment.

22. The apparatus of claim 21, comprising:
a retention system including a spring and the separable part; and
the attachment releasably mountable to the at least one part using the retention system, the attachment, defining a section to receive, or engage, the separable part;
wherein the section includes a hole or at least one surface, the spring to urge the separable part into the hole, or against the at least one surface.

23. The apparatus of claim 21, further comprising a backstrap another modular part;
wherein the backstrap or the other modular part comprises a part of the at least one part, or is configured to attach to the at least one part;
the backstrap or the other modular part defining a cavity to hold at least a portion of the separable part.

24. The apparatus of claim 21, further comprising a body to wedgingly install in a cavity defined by a portion of the at least one part;
the body defining a retention system cavity to hold the seperable part.

25. The apparatus of claim 22, wherein the retention system is configured to constrain the separable part to movement along an axis of movement, to or away from a portion of the hole, or a portion of the at least one surface; and
wherein the axis of movement is at an oblique angle with respect to the plane.

26. The apparatus of claim 1, wherein the grip comprises a trigger hand grip.

27. The kit of parts of claim 16, wherein the at least the portion of the trigger hand grip is part of the front of the trigger hand grip and the grip attachment is a different part of the trigger hand grip.

28. The apparatus of claim 21, wherein the grip attachment comprises a magazine guide including a fully-enclosed magazine well.

29. An apparatus to operate in a recoil environment, the apparatus including:
an attachment configured to slidably couple to a firearm, the attachment including a threadless region to couple to one or more corresponding threadless regions of at least one part:
wherein the attachment includes:
a slidable attachment interface to restrict a coupling movement of the attachment relative to the at least one part, to movement along an axis of movement, wherein the coupling movement is along a plane, wherein the slidable attachment interface comprises a male feature or a female feature of:
a dovetail interface;
a T-slot interface; or
another undercut interface; and
an additional interface associated with a separable part, the additional interface to restrict movement of the attachment relative to the at least one part along the axis of movement;
wherein the separable part includes terminal ends and a length, the length including a tapered section; and
the separable part to urge the attachment in a direction that is parallel with the plane, wherein when the attachment is urged by the separable part 1) at least a portion of a surface of the tapered section in contact with the attachment and 2) another at least a portion of the tapered section is not in contact with the attachment;
wherein the at least the portion of the surface of the tapered section is on one side of the length and the other at least the portion of the surface is on an opposite side of the length.

30. The apparatus of claim 29, wherein the tapered section comprises a tapered nose of the separable part.

* * * * *